US009051223B2

(12) United States Patent
Cox et al.

(10) Patent No.: US 9,051,223 B2
(45) Date of Patent: Jun. 9, 2015

(54) GENERANT GRAIN ASSEMBLY FORMED OF MULTIPLE SYMMETRIC PIECES

(71) Applicant: Autoliv ASP, Inc., Ogden, UT (US)

(72) Inventors: Matthew A. Cox, Centerville, UT (US); Bradley W. Smith, Plain City, UT (US); K. Doyle Russell, Perry, UT (US); Michael Jones, Perry, UT (US)

(73) Assignee: Autoliv ASP, Inc., Ogden, UT (US)

( * ) Notice: Subject to any disclaimer, the term of this patent is extended or adjusted under 35 U.S.C. 154(b) by 42 days.

(21) Appl. No.: 13/833,442

(22) Filed: Mar. 15, 2013

(65) Prior Publication Data

US 2014/0261040 A1 Sep. 18, 2014

(51) Int. Cl.

| | |
|---|---|
| ***C06B 21/00*** | (2006.01) |
| ***C06C 7/02*** | (2006.01) |
| ***C06B 45/00*** | (2006.01) |
| ***C06D 5/06*** | (2006.01) |

(52) U.S. Cl.

CPC . *C06B 21/00* (2013.01); *C06C 7/02* (2013.01); *C06B 45/00* (2013.01); *C06D 5/06* (2013.01)

(58) Field of Classification Search

CPC ..... C06B 21/00; C06B 45/00; C06C 7/02; C06D 5/06

USPC ..... 102/283, 288; 149/2, 109.6; 86/1.1; 280/741

See application file for complete search history.

(56) References Cited

U.S. PATENT DOCUMENTS

| | | | | | |
|---|---|---|---|---|---|
| 677,528 | A | * | 7/1901 | Maxim | 102/288 |
| 694,295 | A | * | 2/1902 | Maxim | 102/288 |
| 2,921,521 | A | | 1/1960 | La Haye et al. | |
| 3,109,374 | A | * | 11/1963 | Rumbel et al. | 102/289 |
| 3,140,659 | A | * | 7/1964 | Artsdalen et al. | 102/430 |
| 3,255,281 | A | | 6/1966 | Alexander | |
| 3,296,794 | A | * | 1/1967 | Nash | 60/39.47 |
| 3,429,264 | A | * | 2/1969 | Oversohl et al. | 102/288 |
| 3,722,354 | A | | 3/1973 | Herty, III | |
| 3,724,870 | A | | 4/1973 | Kurokawa et al. | |

(Continued)

FOREIGN PATENT DOCUMENTS

| | | |
|---|---|---|
| CN | 1303338 | 7/2001 |
| CN | 101506125 | 8/2009 |

(Continued)

OTHER PUBLICATIONS

"Extrusion Process," [online]; [retrieved on Oct. 6, 2006], retrieved from http://www.aec.org/techinfo/prntFriend/expro_prntfrnd.html, 4 pp.

(Continued)

*Primary Examiner* — Bret Hayes

(74) *Attorney, Agent, or Firm* — Stephen T. Olson; Harness, Dickey & Pierce, P.L.C.

(57) ABSTRACT

Pressed and segmented gas generant grain assemblies formed from a plurality of symmetric gas generant pieces or segments are disclosed. The symmetric pieces or segments are arranged circumferentially to define a substantially round, segmented body. In certain variations, the symmetric segments are substantially free of polymeric binder and have a high density. The segmented pressed grain assemblies are more robust and less expensive to manufacture, while still exhibiting desired combustion performance. Methods of making such segmented gas generant grain assemblies are also provided.

20 Claims, 11 Drawing Sheets

(56) References Cited

U.S. PATENT DOCUMENTS 3,779,819 A * 12/1973 Thomas et al. ..... 149/2
3,912,561 A 10/1975 Doin et al.
3,986,908 A 10/1976 Grebert et al.
4,000,231 A 12/1976 Peterson
4,094,248 A * 6/1978 Jacobson ..... 102/288
4,099,376 A 7/1978 Japs
4,131,051 A 12/1978 Schaffling
4,246,051 A 1/1981 Garner et al.
4,300,962 A 11/1981 Stinecipher et al.
4,349,324 A 9/1982 Neff et al.
4,533,416 A * 8/1985 Poole ..... 149/35
4,608,102 A 8/1986 Krampen et al.
4,624,126 A 11/1986 Avila et al.
4,632,813 A 12/1986 Anastasi et al.
4,640,711 A 2/1987 Lichti et al.
4,698,107 A 10/1987 Goetz et al.
4,714,579 A 12/1987 Boden et al.
4,806,180 A 2/1989 Goetz et al.
4,817,828 A 4/1989 Goetz
4,828,474 A 5/1989 Ballantyne
4,846,368 A 7/1989 Goetz
4,876,962 A * 10/1989 Olsson ..... 102/288
4,923,512 A 5/1990 Timm et al.
4,944,528 A 7/1990 Nilsson et al.
4,948,439 A 8/1990 Poole et al.
4,998,751 A 3/1991 Paxton
5,019,220 A 5/1991 Taylor et al.
5,034,070 A 7/1991 Goetz et al.
5,035,757 A 7/1991 Poole
5,051,143 A 9/1991 Goetz
5,074,938 A 12/1991 Chi
5,139,588 A 8/1992 Poole
5,202,067 A 4/1993 Solazzi et al.
5,345,873 A 9/1994 Lauritzen et al.
5,351,619 A 10/1994 Chan et al.
5,388,519 A 2/1995 Guindon et al.
5,407,608 A 4/1995 Knowlden et al.
5,423,261 A 6/1995 Bernardy et al.
5,460,668 A 10/1995 Lyon
5,507,520 A 4/1996 Meduvsky et al.
5,507,890 A 4/1996 Swann et al.
5,518,054 A 5/1996 Mitson et al.
5,531,941 A 7/1996 Poole
5,538,568 A 7/1996 Taylor et al.
5,542,704 A 8/1996 Hamilton et al.
5,562,303 A 10/1996 Schleicher et al.
5,565,710 A 10/1996 Ochi et al.
5,608,183 A 3/1997 Barnes et al.
5,620,205 A * 4/1997 Lauritzen et al. ..... 280/741
5,623,115 A 4/1997 Lauritzen et al.
5,629,494 A 5/1997 Barnes et al.
5,635,668 A 6/1997 Barnes et al.
5,670,740 A 9/1997 Barnes et al.
5,682,013 A 10/1997 Smith et al.
5,738,374 A 4/1998 Marsaud et al.
5,756,929 A 5/1998 Lundstrom et al.
5,756,930 A 5/1998 Chan et al.
5,780,767 A 7/1998 Matsuda et al.
5,804,758 A 9/1998 Marsaud et al.
5,821,449 A 10/1998 Langsjoen et al.
5,834,679 A 11/1998 Seeger
5,879,421 A 3/1999 Liu et al.
5,985,361 A 11/1999 Poulter et al.
5,989,367 A 11/1999 Zeuner
6,007,736 A 12/1999 Zhang et al.
6,029,994 A 2/2000 Perotto et al.
6,032,979 A 3/2000 Mossi et al.
6,039,820 A 3/2000 Hinshaw et al.
6,053,110 A * 4/2000 Marchant et al. ..... 102/288
6,077,372 A 6/2000 Mendenhall et al.
6,101,947 A * 8/2000 Knowlton et al. ..... 102/288
6,103,030 A 8/2000 Taylor
6,129,023 A 10/2000 Marsaud et al.
6,132,480 A 10/2000 Barnes et al.
6,132,537 A 10/2000 Zeuner et al.
6,143,102 A 11/2000 Mendenhall et al.
6,156,136 A 12/2000 Bottaro et al.
6,205,916 B1 3/2001 Castleton
6,214,138 B1 4/2001 Canterberry et al.
6,224,697 B1 5/2001 Mendenhall et al.
6,301,935 B1 10/2001 Audenaert et al.
6,315,930 B1 11/2001 Hamilton
6,322,649 B1 11/2001 Marsaud et al.
6,368,434 B1 4/2002 Espagnacq et al.
6,427,599 B1 8/2002 Posson et al.
6,502,513 B1 * 1/2003 Barnes et al. ..... 102/289
6,517,647 B1 2/2003 Yamato
6,550,808 B1 4/2003 Mendenhall
6,592,691 B2 7/2003 Taylor et al.
6,605,233 B2 8/2003 Knowlton et al.
6,620,266 B1 9/2003 Williams et al.
6,634,302 B1 10/2003 Rink et al.
6,688,231 B1 2/2004 Herrmann
6,689,237 B1 2/2004 Mendenhall
6,712,918 B2 3/2004 Mendenhall et al.
6,752,939 B2 6/2004 Gereg
6,789,485 B2 9/2004 Moquin et al.
6,843,869 B2 1/2005 Mendenhall et al.
6,905,562 B2 6/2005 Hamilton
6,935,655 B2 8/2005 Longhurst et al.
6,941,868 B2 9/2005 Herget
6,958,101 B2 10/2005 Mendenhall et al.
6,984,398 B2 1/2006 Brennan et al.
7,024,342 B1 4/2006 Waite et al.
7,077,428 B2 7/2006 Barker et al.
7,147,733 B2 12/2006 Barnes et al.
7,470,337 B2 12/2008 Mendenhall et al.
7,758,709 B2 7/2010 Hussey et al.
7,814,838 B2 10/2010 McCormick
7,985,309 B2 * 7/2011 Kim ..... 149/3
8,057,610 B2 11/2011 Hussey et al.
8,057,611 B2 11/2011 Brisighella et al.
8,057,612 B2 11/2011 Brisighella et al.
8,156,869 B2 * 4/2012 Dahlberg ..... 102/439
2002/0195181 A1 12/2002 Lundstrom et al.
2003/0037850 A1 2/2003 Helmy et al.
2003/0089883 A1 5/2003 Knowlton et al.
2004/0000362 A1 1/2004 Sato et al.
2004/0050283 A1 3/2004 Daoud
2004/0112244 A1 6/2004 Barker et al.
2004/0154712 A1 8/2004 Yokoyama et al.
2004/0173922 A1 9/2004 Barnes et al.
2004/0200554 A1 10/2004 Mendenhall et al.
2004/0216820 A1 11/2004 Mendenhall et al.
2005/0067076 A1 3/2005 Barnes et al.
2005/0072501 A1 * 4/2005 Blau et al. ..... 149/19.1
2005/0115721 A1 6/2005 Blau et al.
2005/0263223 A1 12/2005 Halpin et al.
2006/0016529 A1 1/2006 Barnes et al.
2006/0054257 A1 3/2006 Mendenhall et al.
2006/0102259 A1 5/2006 Taylor et al.
2007/0084531 A1 4/2007 Halpin et al.
2007/0240797 A1 10/2007 Mendenhall et al.
2007/0277915 A1 12/2007 Hordos
2007/0296190 A1 * 12/2007 Hussey et al. ..... 280/741
2008/0236711 A1 10/2008 Bradford et al.
2009/0044885 A1 * 2/2009 Brisighella et al. ..... 149/18
2009/0205757 A1 8/2009 Gaudre et al.
2009/0255611 A1 10/2009 Lund et al.
2009/0308509 A1 12/2009 Marlin
2010/0116384 A1 5/2010 Mendenhall et al.
2011/0025030 A1 2/2011 Mendenhall et al.

FOREIGN PATENT DOCUMENTS

CN 101952227 1/2011
DE 3933555 2/1991
DE 4006741 8/1991
DE 19501889 7/1995
DE 4318883 12/2003
EP 0324639 7/1989
EP 0728630 8/1996
EP 0757026 2/1997
EP 0767155 4/1997

(56) References Cited

FOREIGN PATENT DOCUMENTS

| | | |
|---|---|---|
| EP | 0870746 | 10/1998 |
| EP | 1118512 | 7/2001 |
| EP | 1142853 | 10/2001 |
| EP | 2035352 | 3/2009 |
| EP | 2190801 | 6/2010 |
| EP | 2265562 | 12/2010 |
| EP | 2346797 | 7/2011 |
| FR | 2873367 | 1/2006 |
| GB | 2219242 | 12/1989 |
| JP | 2010536691 | 12/2010 |
| JP | 2011516395 | 5/2011 |
| WO | WO 89/10257 | 11/1989 |
| WO | WO 99/05079 | 2/1999 |
| WO | WO 01/08937 | 2/2001 |
| WO | WO 03/106378 | 12/2003 |
| WO | WO 2004/024653 | 3/2004 |
| WO | WO 2004/067477 | 8/2004 |
| WO | WO 2006/134311 | 12/2006 |
| WO | WO 2007/042735 | 4/2007 |
| WO | WO 2007/113299 | 10/2007 |
| WO | WO 2007/149173 | 12/2007 |
| WO | WO 2008/035288 | 3/2008 |
| WO | WO 2008/051274 | 5/2008 |
| WO | WO 2008/118273 | 10/2008 |
| WO | WO 2009/023119 | 2/2009 |
| WO | WO 2009/126182 | 10/2009 |
| WO | WO 2009/126702 | 10/2009 |
| WO | WO 2010/056512 | 5/2010 |
| WO | WO 2011/017192 | 2/2011 |

OTHER PUBLICATIONS

"Refinement of tablet compaction models to include compaction kinematics," [online]; [retrieved on Sep. 18, 2006], retrieved from http://www.msm.cam.ac.uk/ccmm/projects/lhh24.html, 6 pp.

"The Use of MADYMO to Elucidate Injury Mechanisms in a Complex, Multiple-Impact Collision," [online]; [retrieved on Feb. 5, 2008], retrieved from http://www-nrd.nhtsa.dot.gov/pdf/nrd-50/ciren/2002/0802fairfax.pdf, 32 pp.

Web page, 1995-2008 Cabot Corporation, Overview of CAB-O-SIL® Untreated Fumed Silicas, http://www.cabot-corp.com/cws/businesses.nsf/CWSID/cswBUS01182001034300PM9596?_OpenDocument, downloaded Oct. 27, 2008, 1 pages.

Web page, U.S. Silica Company, MIN-U-SIL® 40, Jan. 7, 1999, http://www.u-s-silica.com/PDS/Berkley/BerMUS402000.PDF, downloaded Nov. 10, 2008, 1 page.

Web page, Fibertec Inc., Fibertec Functional Fillers—Microglass Milled Glass Fibers, http://www.fibertecinc.com/microglass.htm, downloaded Oct. 27, 2008, 3 pages.

* cited by examiner

GENERANT GRAIN ASSEMBLY FORMED OF MULTIPLE SYMMETRIC PIECES

FIELD

The present disclosure relates to gas generant grain assemblies for inflatable restraint devices and more particularly to gas generant grain assemblies formed of multiple symmetric segment components.

BACKGROUND

This section provides background information related to the present disclosure which is not necessarily prior art.

Passive inflatable restraint systems are used in a variety of applications, such as motor vehicles. Certain types of passive inflatable restraint systems minimize occupant injuries by using a pyrotechnic gas generant to inflate an airbag cushion (e.g., gas initiators and/or inflators) or to actuate a seatbelt tensioner (e.g., micro gas generators), for example. Automotive airbag inflator performance and safety requirements are continually increasing to enhance passenger safety, while concurrently striving to reduce manufacturing costs.

Many conventional gas generant grains are pressed or extruded for use in airbag inflators. Grains with large or complicated geometry are often pressed to achieve the desired designs. Such pressed grains typically are relatively large and considered to be monolithic bodies, as they are a single unitary monolithic grain structure. Monolithic gas generant grain designs have many advantages, such as repeatable and well controlled combustion, by way of non-limiting example. However, they have several potential disadvantages. Large pressed grains require large press equipment (typically a hydraulic press) that is very expensive and often requires a slower cycle time, which in turn increases processing costs. These pressed grains also tend to be somewhat fragile. Broken grains can occur during processing, shipping, or during the life of the product after they are loaded into an airbag inflator. Broken grains during processing results in increased cost due to product scrap, while broken grains during life cycle can be more serious in that they have the potential to result in performance variation within the inflatable restraint device. Thus, it would be desirable to have robust pressed gas generant grains that have reduced breakage and reduced manufacturing costs, while exhibiting many of the performance advantages associated with conventional pressed monolithic grains.

SUMMARY

This section provides a general summary of the disclosure, and is not a comprehensive disclosure of its full scope or all of its features.

In certain variations, the present disclosure provides a segmented gas generant grain assembly comprising a plurality of gas generant segments arranged together circumferentially to define a segmented body of the gas generant grain assembly. Each gas generant segment is pressed and has a shape that is symmetric with respect to at least one axis defined by the segment. Further, each gas generant segment comprises at least one void having a first dimension. In certain variations, each gas generant segment comprises two or more voids having the first dimension. The segmented body has a central aperture having a second diameter or dimension greater than the first dimension.

In other aspects, the present disclosure provides a segmented gas generant grain assembly comprising a plurality of gas generant segments arranged together circumferentially to define a substantially round and segmented body of the gas generant grain assembly. In certain variations, each gas generant segment in a final pressed form has an actual density of greater than or equal to about 95% of the maximum theoretical mass density. Further, each gas generant segment is substantially free of any binder and has a shape that is symmetric with respect to at least one axis defined by the segment. Moreover, each gas generant segment comprises at least one void having a first dimension. In certain variations, each gas generant segment comprises two or more voids having the first dimension. When the plurality of segments is assembled together, the substantially round and segmented body has a central aperture having a second diameter or dimension that is greater than the first dimension.

In yet other variations of the present disclosure, methods of making segmented gas generant grain assemblies are provided. For example, one such method comprises conveying a plurality of gas generant segments to a round receptacle capable of receiving the gas generant segments. Each gas generant segment has a shape that is symmetric with respect to at least one axis defined by the segment. The method includes sequentially introducing the respective gas generant segments into the round receptacle, where each symmetric segment self-orients to be arranged circumferentially within the round receptacle to form a segmented gas generant grain assembly having a substantially round body. In certain variations, the method also comprises removing the segmented gas generant grain assembly thus formed from the round receptacle.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 2A shows a single symmetric gas generant segment or piece, while FIG. 2B shows three symmetric segments like that in FIG. 2A assembled into a single segmented gas generant grain assembly according to certain embodiments of the present disclosure;

FIG. 3A shows a single symmetric gas generant segment or piece, while FIG. 3B shows four symmetric segments like that in FIG. 3A assembled circumferentially to form a segmented gas generant grain assembly;

Figure 4B:
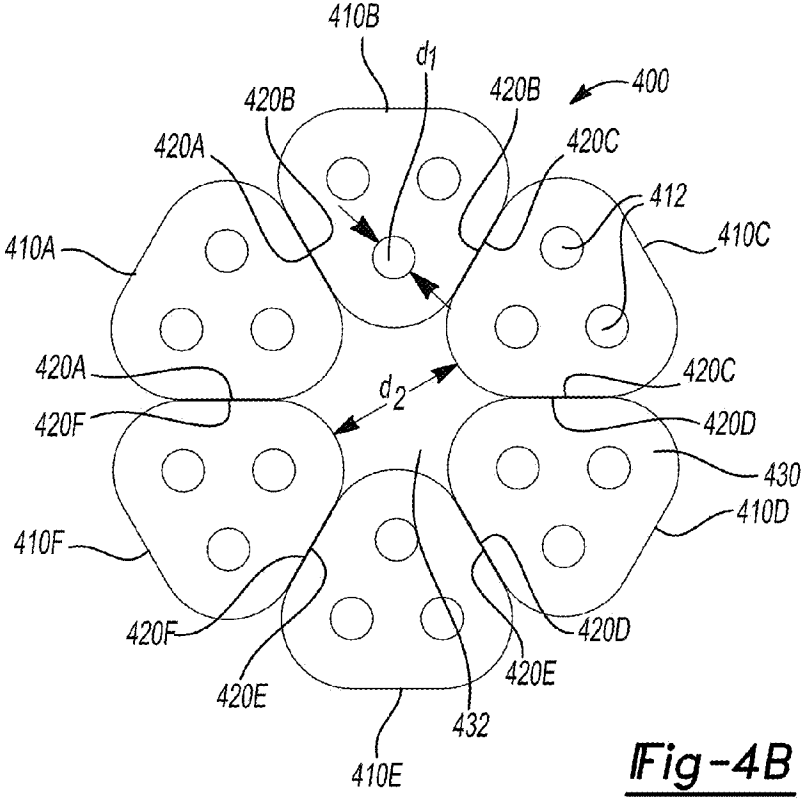
Figure 4A:
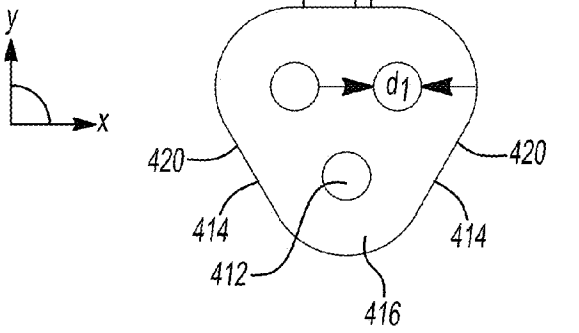
Figure 4C:
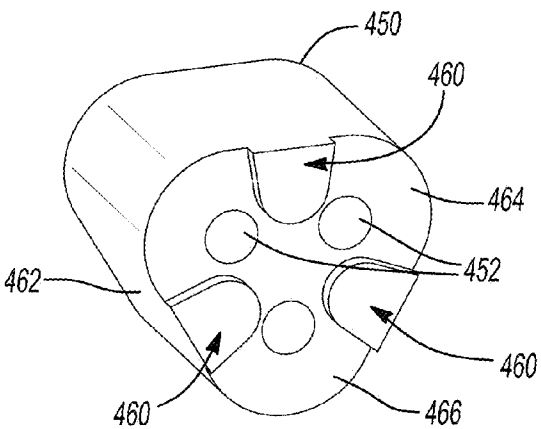
Figure 5A:
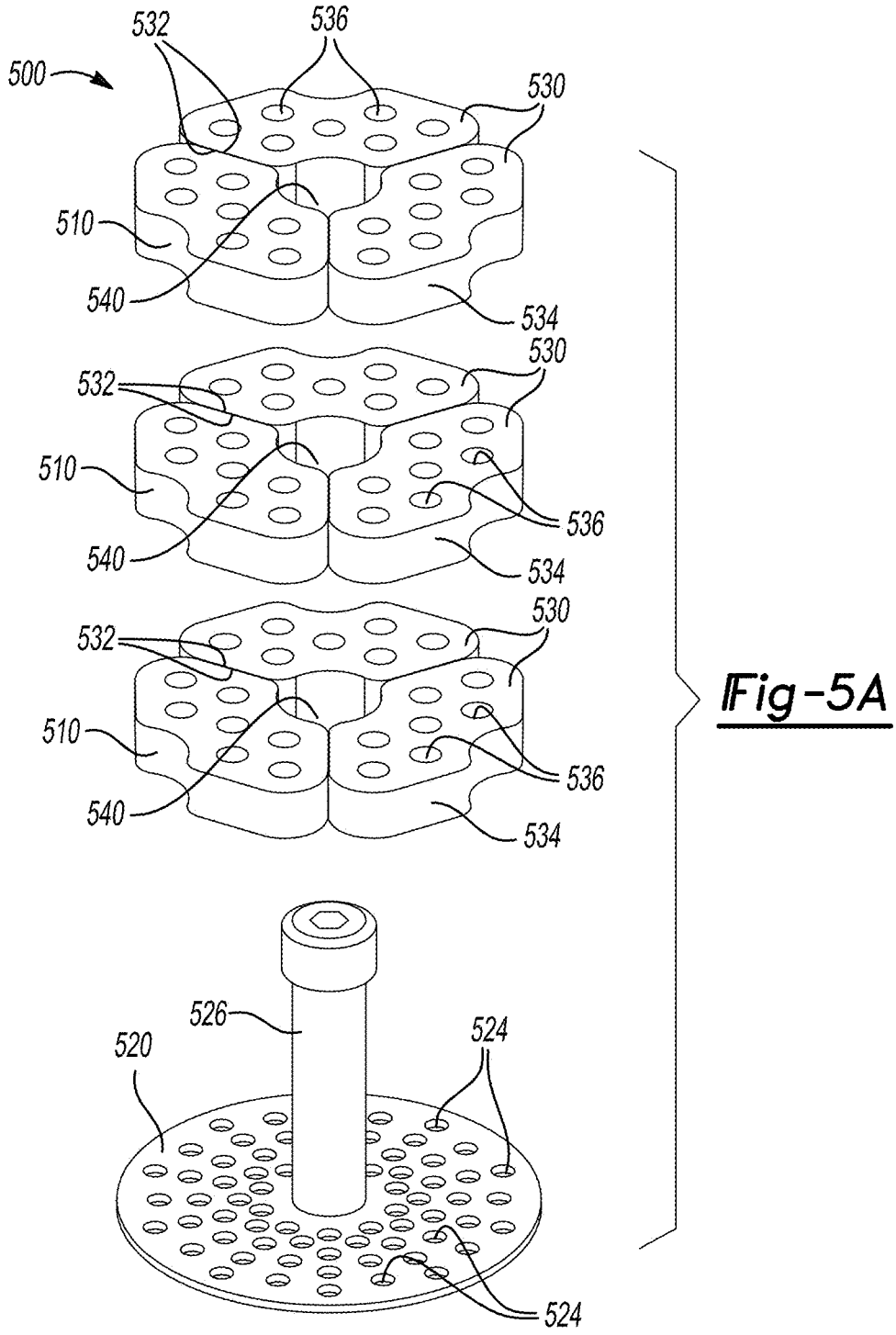
Figure 6A:
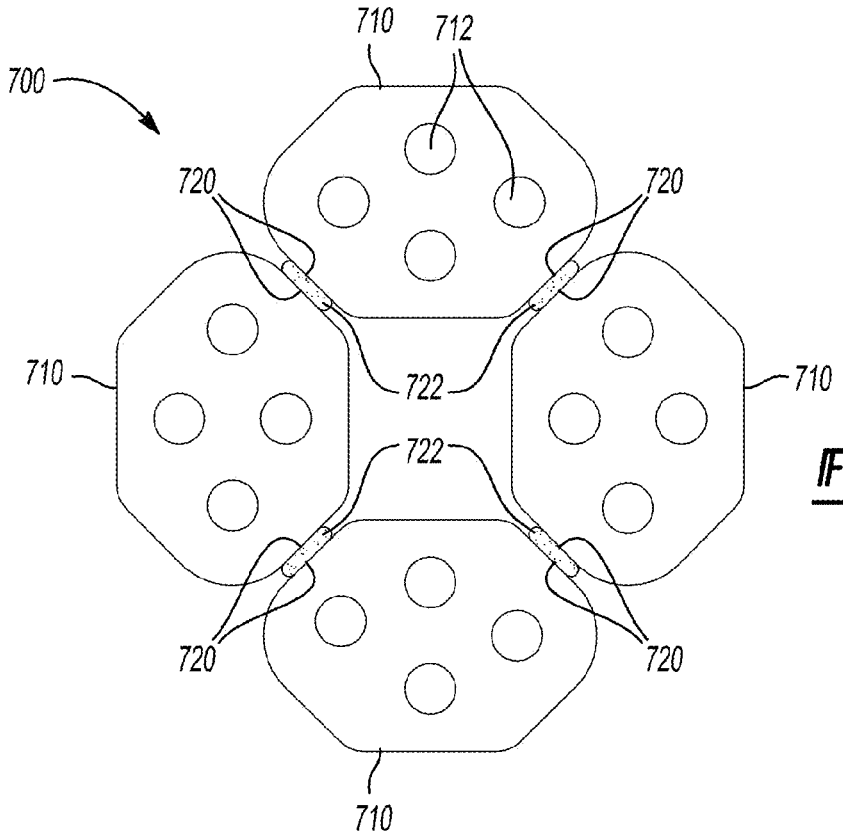
Figure 6B:
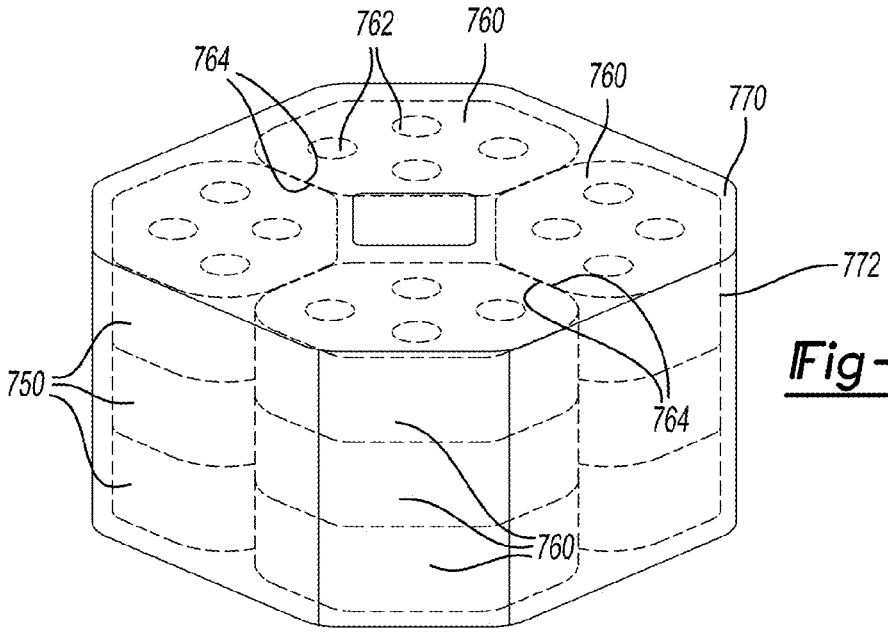
Figure 7A:
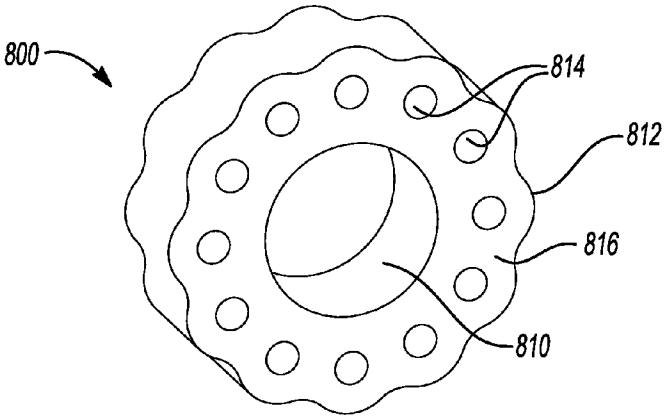
Fig-7A PRIOR ART
Figure 7B:
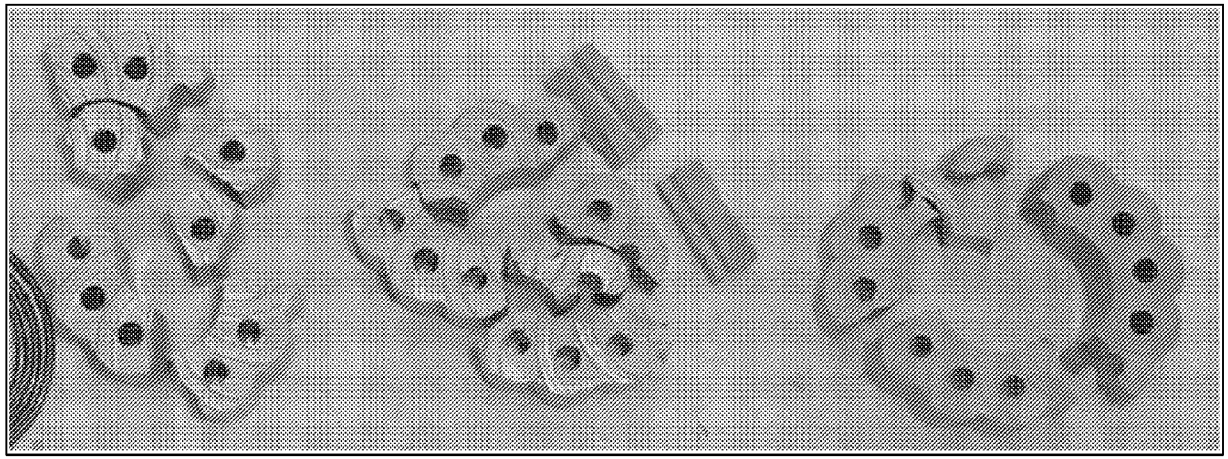
Fig-7B PRIOR ART

FIGS. 4A-4C. FIGS. 4A-4B show another gas generant grain assembly according to certain variations of the present disclosure. FIG. 4A a single symmetric gas generant segment or piece, while FIG. 4B shows six symmetric segments like that in FIG. 4A circumferentially assembled into a segmented gas generant grain assembly to form an embodiment according to certain aspects of the present disclosure. FIG. 4C shows another alternative variation of a single symmetric gas generant segment or piece according to certain aspects of the present disclosure similar to that in FIG. 4A, but having surface contour regions to define offsets or standoffs between gas generant segments when assembled into a segmented gas generant grain assembly and stacked;

FIGS. 5A-5E. FIG. 5A shows an exploded view of a gas generant stack having three distinct segmented gas generant grain assemblies to be disposed on a strainer component around a central pin. Each gas generant grain assembly has three symmetric segments that together define the gas generant grain assembly. FIGS. 5B-5E show progressive steps in an assembly process according to certain aspects of the present disclosure for creating the gas generant stack shown in FIG. 5A from segmented symmetric gas generant pieces;

FIGS. 6A-6B. FIG. 6A shows an alternative variation of a segmented gas generant grain assembly according to certain variations of the present disclosure, where the plurality of symmetric gas generant segments that together define the gas generant grain assembly are attached to one another via a binder or adhesive. FIG. 6B shows another variation of the present disclosure having a plurality of distinct symmetric gas generant segments that together define the segmented gas generant grain assembly joined together by an external circumferential banding;

FIGS. 7A-7B. FIG. 7A shows a conventional pressed gas generant grain shape having a monolithic unsegmented body for purposes of comparison. FIG. 7B shows a photograph of conventional gas generant grains like in FIG. 7A after horizontal drop testing.

Figure 8A:
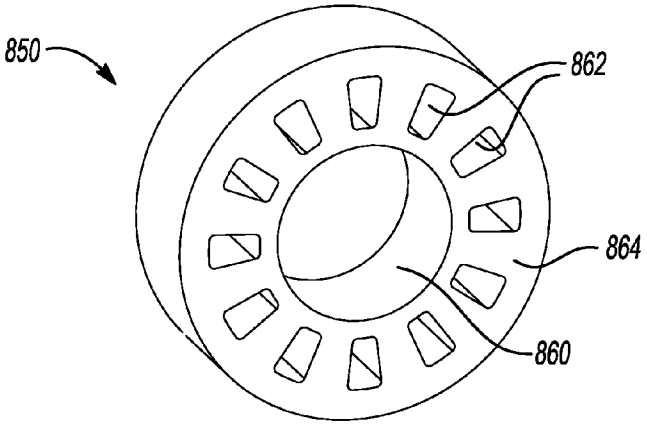
Fig-8A PRIOR ART
Figure 8B:
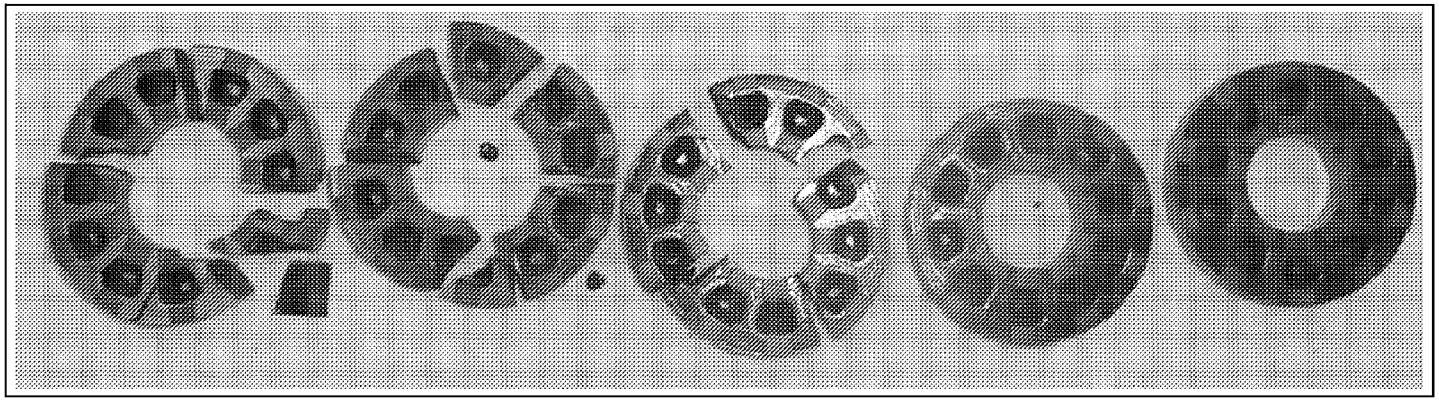
Fig-8B PRIOR ART

FIGS. 8A-8B. FIG. 8A shows another conventional a conventional pressed gas generant grain shape having a monolithic unsegmented body for purposes of comparison. FIG. 8B shows a photograph of conventional gas generant grains like in FIG. 8A after horizontal drop testing.

Figure 9:
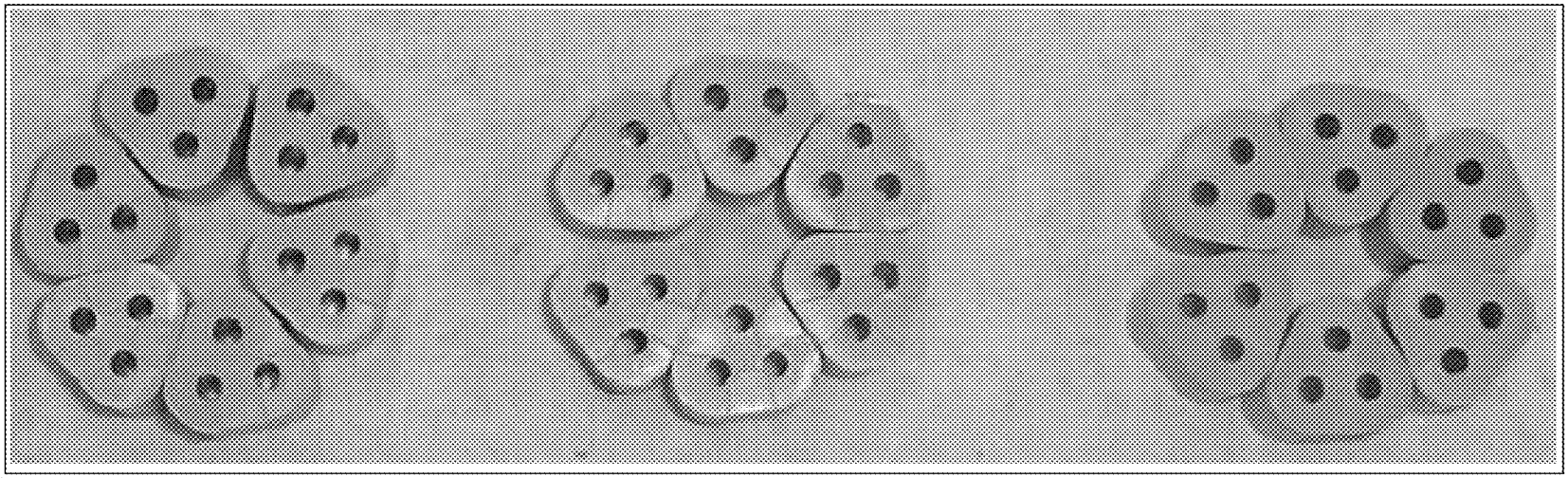

FIG. 9 is a photograph taken after horizontal drop testing of a segmented gas generant grain assembly prepared in accordance with certain aspects of the present disclosure comprising six segmented symmetric gas generant pieces having a design like that shown in FIG. 4B.

Figure 10:
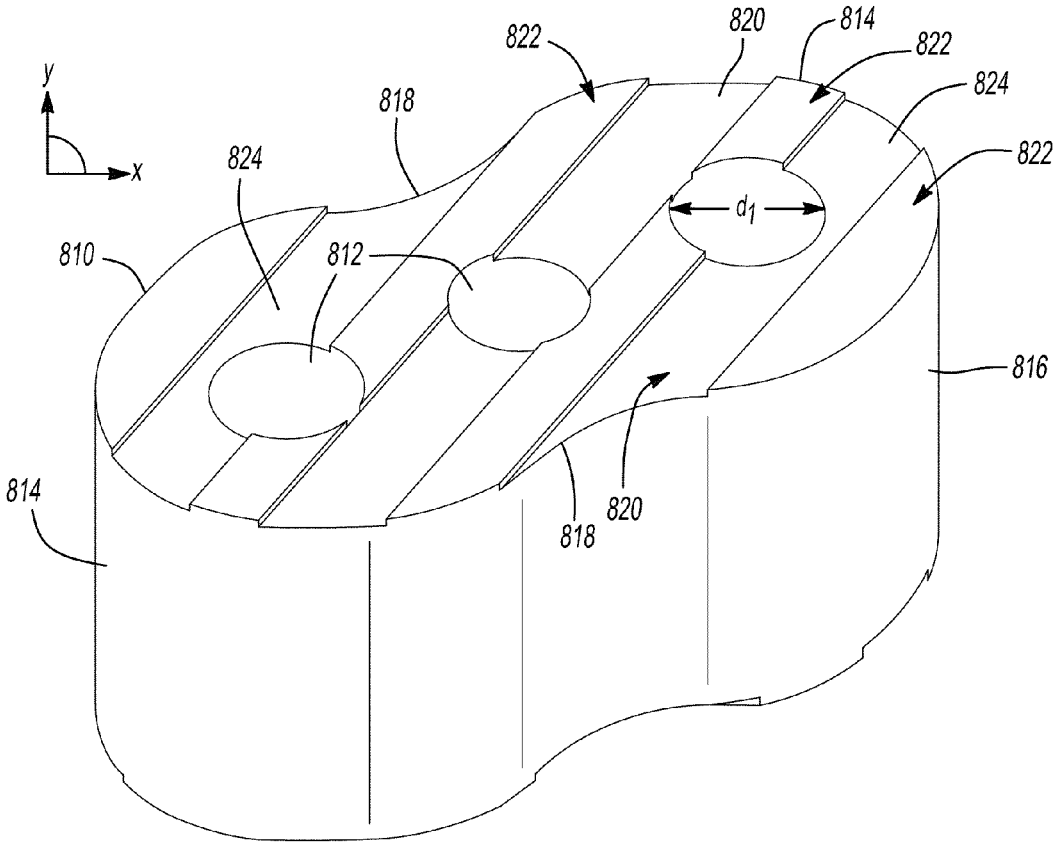

FIG. 10 shows an alternative variations of another symmetric gas generant grain segment prepared in accordance with certain variations of the present disclosure having surface contours formed on a surface of a body of the gas generant grain segment by a plurality of recessed regions that define offsets or standoffs when symmetric gas generant segments are assembled into a segmented gas generant grain assembly and/or are stacked on one another.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. As used herein, the term "and/or" includes any and all combinations of one or more of the associated listed items. Although the terms first, second, third, etc. may be used herein to describe various components, elements, regions, layers and/or sections, these components, elements, regions, layers and/or sections should not be limited by these terms. These terms may be only used to distinguish one element, component, region, layer or section from another region, layer or section. Terms such as "primary," "secondary," "first," "second," or and other numerical terms when used herein do not imply a sequence or order unless clearly indicated by the context. Thus, a first or primary component, element, region, layer or section discussed below could be termed a secondary component, element, region, layer or section without departing from the teachings of the example embodiments.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters.

As referred to herein, ranges are, unless specified otherwise, inclusive of endpoints and include disclosure of all distinct values and further divided ranges within the entire range. Thus, for example, a range of "from A to B" or "from about A to about B" is inclusive of A and of B. Disclosure of values and ranges of values for specific parameters (such as weight percentages, temperatures, molecular weights, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9. Example embodiments will now be described more fully with reference to the accompanying drawings.

The present disclosure is drawn to gas generant grain assemblies and methods for making such gas generant grain assemblies suitable for use in inflatable restraint devices. By way of background, inflatable restraint devices have applicability for various types of airbag module assemblies for automotive vehicles, such as driver side, passenger side, side impact, curtain and carpet airbag assemblies, for example, as well as with other types of vehicles including, for example, boats, airplanes, and trains. Such pyrotechnic gas generants can also be used in other applications where rapid generation of gas is required, such as seat belt restraints, for example.

Figure 1:
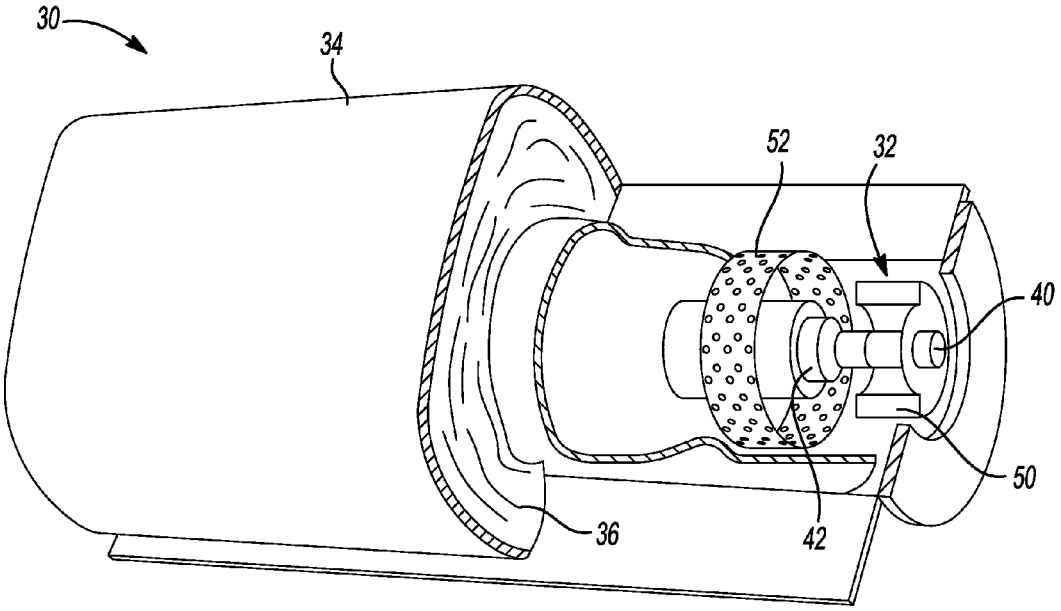
Fig-1 PRIOR ART
FIG. 1 is a partial cross-sectional view of an exemplary passenger-side airbag module including an inflator for an inflatable airbag restraint device.

Gas generants, also known as ignition materials, propellants, gas-generating materials, and pyrotechnic materials are used in inflators of airbag modules, such as a simplified exemplary airbag module 30 comprising a passenger compartment inflator assembly 32 and a covered compartment 34 to store an airbag 36 of FIG. 1. A gas generant material 50 burns to produce the majority of gas products that are directed to the airbag 36 to provide inflation. Such devices often use a squib or initiator 40 which is electrically ignited when rapid deceleration and/or collision is sensed. The discharge from the squib 40 usually ignites an igniter material 42 that burns rapidly and exothermically, in turn, igniting a gas generant material 50.

The gas generant 50 can be in the form of a solid grain, a pellet, a tablet, or the like. The present disclosure pertains to gas generants 50 in the form of grains, meaning a solid compressed high density body formed of a gas generant composition having minimal or no binders, as will be discussed in greater detail below. Impurities and other materials present within the gas generant 50 facilitate the formation of various other compounds during the combustion reaction(s), including additional gases, aerosols, and particulates. Often, a slag or clinker is formed near the gas generant 50 during burning. The slag/clinker often serves to sequester various particulates and other compounds. However, a filter 52 is optionally provided between the gas generant 50 and airbag 36 to remove particulates entrained in the gas and to reduce gas temperature of the gases prior to entering the airbag 36. The quality and toxicity of the components of the gas produced by the gas generant 50, also referred to as effluent, are important because occupants of the vehicle are potentially exposed to these compounds. It is desirable to minimize the concentration of potentially harmful compounds in the effluent.

Various different gas generant compositions (e.g., 50) are used in vehicular occupant inflatable restraint systems. Gas generant material selection involves various factors, including meeting current industry performance specifications, guidelines and standards, generating safe gases or effluents, handling safety of the gas generant materials, durational stability of the materials, and cost-effectiveness in manufacture, among other considerations. It is preferred that the gas generant compositions are safe during handling, storage, and disposal, and preferably are azide-free.

In various aspects, the gas generant typically includes at least one fuel component and at least one oxidizer component, and may include other minor ingredients, that once ignited combust rapidly to form gaseous reaction products (e.g., $CO_2$, $H_2O$, and $N_2$). One or more fuel compounds undergo rapid combustion to form heat and gaseous products; e.g., the gas generant burns to create heated inflation gas for an inflatable restraint device or to actuate a piston. The gas-generating composition also includes one or more oxidizing components, where the oxidizing component reacts with the fuel component in order to generate the gas product.

Improved gas generator performance in an inflatable restraint system may be achieved in a variety of ways, many of which ultimately depend on the gas generant formulation to provide the desired properties. Ideally, a gas generant provides sufficient gas mass flow in a desired time interval to achieve the required work impulse for an inflating device (e.g., airbag) within the inflatable restraint system. Although a temperature of gas generated by the gas generant influences the amount of work gases can do, high gas temperatures may be undesirable because burns and related thermal damage can result. Consequently, in certain aspects, it is desirable to provide a gas generant formulation for an inflatable restraint system that can achieve a high gas output at a high mass flow rate at relatively low flame temperatures.

Inflatable restraint devices generate gas in situ from a reaction of a pyrotechnic gas generant contained therein. In accordance with various aspects of the present disclosure, gas generant grain assemblies are formed that have desirable compositions and shapes that result in superior performance characteristics in an inflatable restraint device. In various aspects, the disclosure provides methods of making pressed gas generant grain assemblies that are robust and have lower breakage rates and manufacturing costs, while still having desirable properties associated with conventional monolithic gas generant grain assemblies having complex shapes, including high burn rates (i.e., rate of combustion reaction), high gas yields (moles/mass of generant), high achieved mass density, high theoretical density, and high loading density.

In various aspects, the present disclosure provides pressed gas generant grain assemblies, which are segmented, and thus comprise a plurality of symmetric gas generant pieces or segments. Each of the symmetric gas generant segments is pressed and comprises a gas generant material. The symmetric pieces or segments are arranged together circumferentially to define a segmented body of the pressed gas generant grain assembly. In certain aspects, the symmetric segments of the pressed segmented monolithic gas generant grain assemblies are substantially free of polymeric binder and have a high density, in contrast to conventional extruded gas generants that have polymeric binders and relatively low density. The term "substantially free" as referred to herein is intended to mean that the compound is absent to the extent that that undesirable and/or detrimental effects are avoided. In the present embodiment, a gas generant that is "substantially free" of binder comprises less than or equal to about 1% by weight binder, optionally less than or equal to about 0.5% by weight, and in certain embodiments comprises 0% by weight of the binder. Such symmetric segment pieces in accordance with the present technology may be formed into unique shapes that when assembled with other symmetric segments form segmented gas generant grain assemblies having an overall shape that optimizes the ballistic burning profiles of the materials contained therein. In segmenting a pressed grain assembly in accordance with various aspects of the present teachings, a more robust and less expensive gas generant having the desired performance properties is realized.

Various aspects of the disclosure provide forming a segmented gas generant having a grain assembly shape tailored to create rapid heated gas, like conventional monolithic unsegmented grains. Exemplary conventional monolithic gas generant grain shapes, formed as a single unitary unsegmented monolithic body, are described in commonly assigned U.S. Pat. Nos. 7,758,709 and 8,057,610 both to Hussey, et al. Suitable examples of gas generant compositions having desirable burn rates, density, and gas yield for inclusion in the gas generants manufactured in accordance with the present disclosure include those described in commonly assigned U.S. Pat. No. 6,958,101 to Mendenhall et al. However, any suitable fuels known or to be developed in the art that can provide gas generants having the desired burn rates, gas yields, and density described above are contemplated for use with the teachings of the present disclosure. The disclosures of U.S. Pat. Nos. 7,758,709, 8,057,610, and 6,958,101 are incorporated by reference as if fully set forth herein.

Such conventional monolithic pressed grains desirably exhibit a profile of the combustion pressure curve that is progressive to neutral, in accordance with desired ballistic behavior for gas generant grains. Progressive to neutral combustion pressure curves relate to improved protection for occupants, especially out-of-position occupants. The profile of this pressure curve relates to the amount of surface area of the gas generant which correlates to the mass of generant reacting, hence the mass gas generation rate ($m_g$) and pressure of gas generated over time. This concept can also be expressed as a "rise rate" which is the rate at which the gas output from an inflator increases pressure (usually measured when the gas output is directed to a closed volume).

As background, it is commonly desirable that an inflatable restraint airbag cushion initially inflates in a relatively gradual manner to reduce injury to an occupant (particularly where the occupant is too close to the airbag or "out-of-position") which is then followed by a period where the inflation gas passes into the airbag cushion at a relatively greater or increased pressure rate. A gas generant that creates such inflation is commonly referred to in the art as producing inflation gas in an "S" curve. Suitable gas generants approach a rise rate having an S curve, which is highly desirable, particularly for out-of-position occupants. Thus, desirable segmented pressed gas generant grain assembly designs prepared in accordance with the present disclosure provide a lower rise rate, while providing a higher average combustion pressure and superior control over the burning characteristics. Additionally, the absence of polymeric binder and/or perchlorate oxidizing agents in the segmented pressed gas generant grain assemblies prepared in accordance with the present disclosure, as compared to conventional extruded grains for example, improves burning characteristics and improves effluent quality.

This may be attributed to several aspects of the high density pressed grain assemblies, including that the gas generant composition is substantially free of polymeric binder and can be free of associated co-oxidizers, such as perchlorates, which raise the combustion flame temperature. Where combustion temperatures are higher, it has generally been observed that higher combustion temperatures result in greater levels or relative amounts of carbon monoxide (CO) and nitrogen oxides ($NO_x$) combustion products, for example. In various aspects, a maximum combustion temperature (also expressed as flame temperature) for a segmented gas generant grain assembly prepared in accordance with the present disclosure is optionally less than about 2,300 K, for example, the flame temperature during combustion is about 1,400 K to about 2,300 K. In certain aspects, the flame temperature is optionally less than about 2,000 K.

Thus, in various aspects, the present disclosure provides a gas generant formed of a plurality of segments arranged together to form an overall grain assembly shape tailored to create rapid heated gas and provide other advantages associated with conventional monolithic gas generant grains. Such a segmented gas generant grain assembly provides various advantages over conventional monolithic unitary body gas generant grains, including lower breakage rates, greater robustness, and reduced manufacturing costs. Thus, in various aspects, the present teachings contemplate using multiple small, simple pressed grain segments or pieces to create a large gas generant grain body assembly. Furthermore, each pressed grain segment has a symmetric shape designed to have at least two distinct contact sides that are complementary to adjacent symmetric segments also having such contact sides. In this manner, each symmetric segment is capable of being placed in near proximity to and/or contact with another adjacent symmetric segment to nest tightly together to form a compact gas generant assembly shape. Such small grain segments have a symmetric shape that enables self-orientation of the respective segment pieces into larger round grain assembly shapes, especially when loaded onto a track during an assembly process. The ability to form a compact overall gas generant assembly by self-orientation of the symmetric segments eliminates the necessity for pins, fingers, or other components to retain the respective pieces together.

Figure 2A:
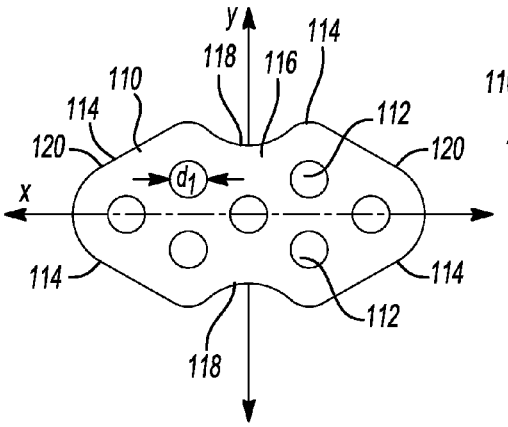
FIGS. 2A-2B show a gas generant grain assembly according to certain aspects of the present disclosure.
Figure 2B:
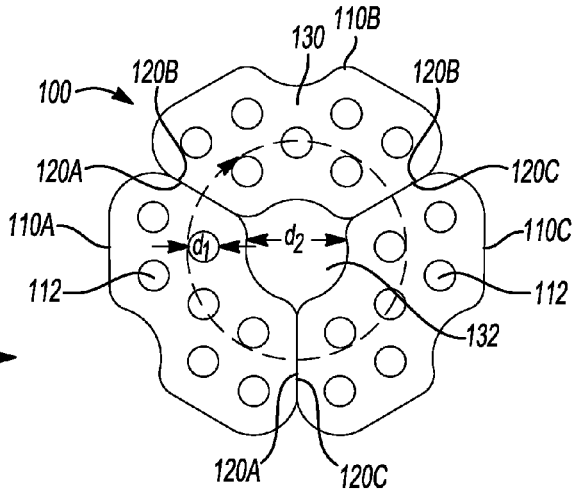

In one variation shown in FIGS. 2A-2B according to certain aspects of the present disclosure, a pressed gas generant grain assembly 100 is formed and has a generally round shape, for example, in the general form of a disc. By "generally round," it is meant that the shape of the gas generant body has an overall circular, oval, oblong, or elliptical shape, but may also have concave and convex portions that deviate from a perfectly circular, oval, oblong, or elliptical shape to achieve more complex designs. A single gas generant segment 110 is shown in FIG. 2A. The pressed gas generant grain assembly 100 in FIG. 2B is formed of three identical gas generant segments (designated 110A-110C in FIG. 2B). Each gas generant segment 110 has a symmetric shape. Generally, a symmetric shape can be understood to mean that a shape has at least one axis of symmetry, so that if the shape is bisected along a centrally disposed plane corresponding to a first axis (e.g., projecting upwards from the page along the designated x-axis in FIG. 2A, for example), one bisected portion is substantially the same as the other bisected portion. The x-axis corresponds to the longitudinal axis of the shape for gas generant segment 110 in FIG. 2A. If gas generant segment 110 is bisected along a centrally disposed plane corresponding to the x-axis, each bisected portion would have the same shape. Hence, gas generant segment 110 has a shape that has two distinct axes of symmetry, namely the shape is symmetric with respect to both an x-axis and an orthogonal y-axis defined by the segment. Thus, when gas generant segment 110 is bisected along a centrally disposed plane corresponding to a distinct y-axis (e.g., projecting upwards from the page along the designated y-axis in FIG. 2A, for example), each bisected portion defined by the centrally disposed y-axis plane has the same shape.

The gas generant segment 110 comprises a gas generant material and is pressed to form a small grain. Suitable gas generant materials are discussed in further detail below. The gas generant segment 110 comprises at least one void that has a first dimension ($d_1$). As shown in FIG. 2A, the void is in the form of an aperture 112 that extends through a body region 116 of the gas generant segment 110 to permit fluid communication therethrough. In certain preferred variations, the gas generant segment 110 comprises two or more apertures 112 having the first dimension ($d_1$), which in this embodiment is a diameter of each round aperture 112. In gas generant segment 110, seven distinct apertures 112 are formed in a body region 116. The apertures 112 are disposed within body region 116 at equal distances from one another and notably, like the overall symmetric shape of the gas generant segment 110, are likewise disposed symmetrically within the body region 116 of the gas generant segment 110. The apertures 112 are substantially round, thus forming cylindrical openings through body region 116 to permit fluid communication therethrough. While not shown, the voids or apertures 112 need not have the same dimension or diameter in every embodiment, need not have a substantially round shape, and need not be disposed symmetrically within the body region 116, although in certain aspects it is preferred. Thus the first diameter ($d_1$) may instead refer to a dimension across the void or aperture for alternative shapes. Notably, the voids in alternative variations are not required to extend fully through the body region 116 and thus may not permit fluid communication therethrough. Moreover, while not shown here, in such alternative embodiments, the voids that extend into the body region 116 need not necessarily align on each side, but rather may be offset or disposed in different positions from the top and bottom.

The overall shape defined by the perimeter of the gas generant segment 110 in FIG. 2A is similar to an oval shape, having four sides 114 interspersed with two concave side regions 118. Furthermore, the gas generant segment 110 defines at least two distinct contact sides 120 designed to be complementary in shape to adjacent gas generant segments, so that complementary or conforming sides of two distinct adjacent symmetric gas generant segments can be assembled into near proximity and/or contact with one another. In certain alternative embodiments, complementary contact sides on adjacent segments are not required to have a shape that establishes full contact along the entire length of the side, but rather may provide multiple contact points along the side when the gas generant segments are circumferentially arranged together to form the gas generant grain assembly.

Thus, the plurality of symmetric gas generant segments 110A-110C can be assembled together in a circumferential pattern (see dotted central radial line in FIG. 2B) to form a closed substantially round shape. The term "circumferential" is intended to mean a continuous path or line that forms an outer border or perimeter, which surrounds and thus defines an enclosed region of space. Such a continuous path starts at one location along the outer border or perimeter and translates along the outer border until it is completed at the original starting point to enclose the defined region of space. Therefore, a circumferential arrangement forms a shape through which a continuous line can be traced around a region of space and which starts and ends at the same location. Still further, a circumferential path or pattern may include one or more of several shapes, and may be, for example, circular, oblong, ovular, elliptical, or otherwise planar enclosures, which generally corresponds to a substantially round shape.

The plurality of three symmetric gas generant segments 110A-110C are arranged together circumferentially to define a substantially round segmented body 130 of the pressed gas generant grain assembly. Each respective contact side face is adjacent to (in near proximity with) and in contact with another distinct contact side. Thus, a contact side 120A of gas generant segment 110A meets a contact side 120C of gas generant segment 110C, while another contact side 120A of gas generant segment 110A meets and interfaces with a contact side 120B of gas generant segment 110B on a second opposite side. Similarly, another contact side 120B of gas generant segment 110B meets the other contact side 120C of gas generant segment 110C. As arranged in contact with one another, circumferentially assembled gas generant segments 110A-110C form a ring or substantially round segmented body 130. The substantially round segmented body 130 thus has a centrally disposed aperture 132 that defines a second dimension or diameter "$d_2$." While not shown, the centrally disposed aperture 132 need not have the same diameter in every embodiment and need not have a substantially round shape, although in certain aspects it is preferred. Thus the second diameter ($d_2$) may instead refer to a second dimension across the centrally disposed aperture having an alternative shape. In various aspects, the second diameter $d_2$ of centrally disposed aperture 132 is larger than the first dimension or diameter $d_1$ of the plurality of apertures 112 in the plurality of gas generant segments 110. The centrally disposed aperture 132 may be sized to receive a pin, squib, an auto-ignition material or other componentry within the inflator assembly, as are well known in the art.

The inventive gas generant designs provide particular advantages over the conventional monolithic unitary body pressed gas generants. While forming a gas generant grain assembly of multiple pieces might initially appear to add greater manufacturing complexity by having to form multiple pieces and the subsequent assemblage steps required, in various aspects, formation of small symmetric segments assembled into a larger segmented grain assembly has significant advantages. First, the assembly of a plurality of symmetric gas generant segments arranged together circumferentially to define a segmented body actually has the potential to provide a lower cost manufacturing process. This is because the segments can be pressed to appropriate densities on smaller high-speed rotary presses, as compared to the relatively large and pressed unitary body monolithic gas generant grains, which require much higher capacity, larger hydraulic presses which have much slower processing speeds. Thus, despite the additional complexity of forming multiple pieces that have to be arranged and assembled together, the ability to form the smaller grain segments on smaller presses actually realizes manufacturing cost reductions.

Further, the small grains are much more robust that larger grains. As discussed below, drop test results show significant improvement for a segmented gas generant grain assembly formed of a plurality of smaller symmetric gas generant segments. It is believed that the smaller grain segments introduce multiple slip planes within the assembly to allow them to absorb energy and move without breakage. Furthermore, the packaging required for less fragile, more robust gas generant assemblies prepared in accordance with the present teachings reduces costs of packaging and transport costs. Thus, despite the apparent advantages to forming a conventional unsegmented monolithic gas generant grain in a single pressing step, the potential fragility actually increases costs through high rates of breakage during manufacturing and more expensive packaging and transport. In certain variations, a segmented body of a pressed gas generant grain assembly prepared in accordance with the present disclosure has a rate of breakage significantly less than that of a comparative rate of breakage for a comparative monolithic unsegmented gas generant grain defining the same gas generant grain shape, as will be discussed further below. Further, enhanced robustness of a gas generant grain assembly reduces performance variability once the inflator assembly is in service within a vehicle. Additionally, small grain segments permit more flexibility in gas generant grain assembly design. For example, the inventive technology permits easier integration of an auto-ignition material, where one of the small grain segments can be replaced with a grain segment made from an auto-ignition material. Such flexibility in design significantly improves bonfire test performance, but does not significantly degrade inflator performance.

Thus, in certain aspects, the present teachings provide a pressed gas generant grain assembly comprising a plurality of symmetric gas generant segments arranged together circumferentially to define a segmented body of the pressed gas generant grain assembly. In certain aspects, the gas generant grain assembly comprises 3 to 6 symmetric gas generant segments that define the segmented body. Each symmetric gas generant segment is pressed and comprises at least one void having a first dimension. In certain variations, each symmetric gas generant segment comprises two or more voids having the first dimension. In certain preferred variations, each gas generant segment comprises at least two or more voids in the form of apertures having a first dimension or diameter. In certain variations, each symmetric gas generant segment comprises 3 to 7 apertures having the first dimension or diameter.

Further, each symmetric gas segment has a shape that is symmetric with respect to at least one axis of symmetry. In certain variations, the shape of each symmetric gas generant segment is symmetric with respect to two distinct axes of symmetry, such as an x-axis and a y-axis of the segment. Furthermore, in certain aspects, each symmetric gas generant segment has the shape defining 3 to 6 distinct sides. The shape may also comprise one or more concave or convex side regions. Each symmetric gas generant segment defines at least two distinct sides for being placed in proximity to or contact with adjacent complementary sides of two distinct adjacent symmetric gas generant segments. When the plurality of symmetric segments is assembled together, the segmented body thus formed has a central aperture having a second dimension or diameter. The second dimension or diameter is greater than the first dimension or diameter.

Figure 3B:
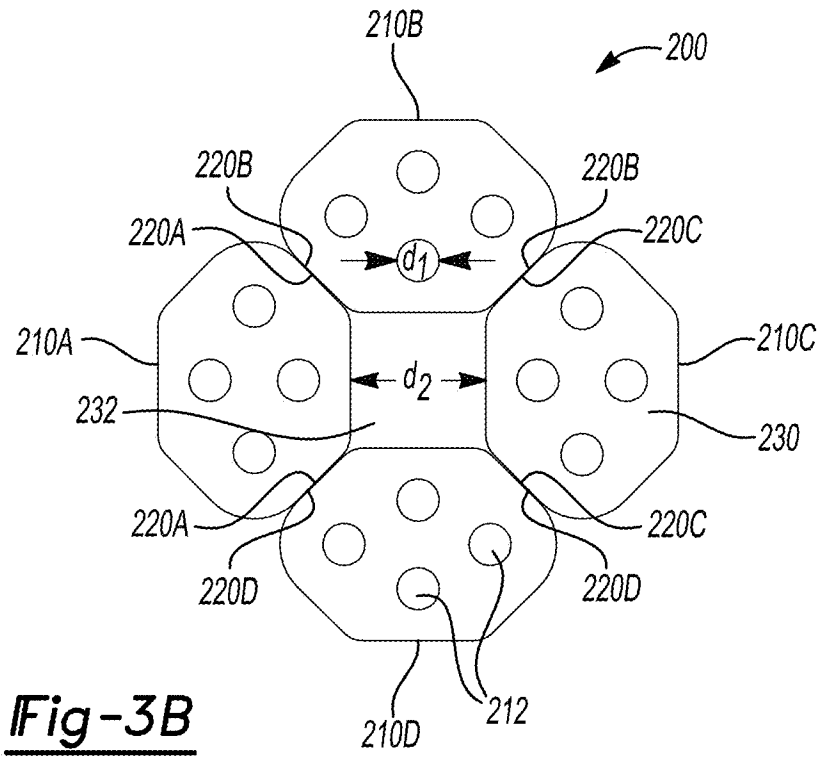
FIGS. 3A-3B show another gas generant grain assembly according to certain variations of the present disclosure.
Figure 3A:
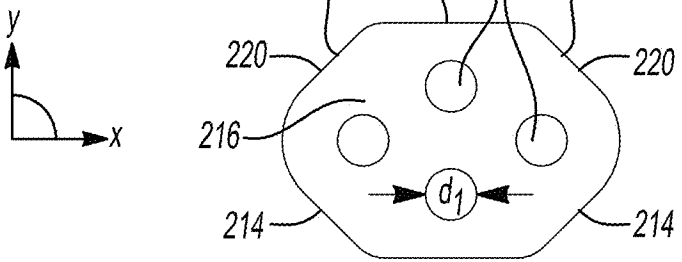

Another embodiment of a segmented gas generant grain assembly 200 according to certain aspects of the present disclosure is shown in FIGS. 3A-3B. FIG. 3A shows a single symmetric gas generant piece or segment 210. The single symmetric gas generant segment 210 comprises a gas generant material and is pressed to form a small high density grain. FIG. 3B shows four symmetric gas generant segments 210A-210D (like 210 in FIG. 3A) assembled in a circumferential pattern into the single gas generant grain assembly 200 having a substantially round shape. Each gas generant segment 210 has a symmetric shape. In FIG. 3A, the each gas generant segment 210 has 6 sides 214. The shape of gas generant segment 210 has two axes of symmetry, namely along the x-axis and the y-axis defined by the generally oblong polygonal shape.

The gas generant segment 210 comprises at least one void having a first dimension, more specifically at least two or more apertures 212 having the first diameter ($d_1$). In gas generant segment 110, four distinct apertures 212 are formed in a body region 216. The apertures 212 are disposed within body region 216 at equal distances from one another and notably, like the symmetric overall shape of the gas generant segment 210, are disposed symmetrically within the body region 216 of the gas generant segment 210. The apertures 212 are substantially round, thus forming cylindrical openings through body region 216. Like, the previous embodiment, while not shown, variations in dimensions, shape, and distribution with the body region 216 are contemplated. Furthermore, the gas generant segment 210 defines at least two distinct contact sides 220 having a complementary shape to adjacent gas generant segments.

Thus, the plurality of symmetric gas generant segments 210A-210D can be assembled together in a circumferential pattern to form a closed substantially round shape. A contact side 220A of gas generant segment 210A meets a contact side 220D of gas generant segment 210D, while another contact side 220A of gas generant segment 210A meets and interfaces with a contact side 220B of gas generant segment 210B on a second opposite side. Similarly, another contact side 220B of gas generant segment 210B meets the other contact side 220C of gas generant segment 210C. The opposite contact side 220C of gas generant segment 210C contacts contact side 220D of gas generant segment 210D.

As arranged in contact with one another, circumferentially assembled gas generant segments 210A-210D form a ring or substantially round segmented body 230. The substantially round segmented body 230 thus has a centrally disposed aperture 232 that defines a second diameter "$d_2$." Notably, the centrally disposed aperture 232 has a rectangular/square cross-sectional shape in FIG. 3B. Thus, the diameter "$d_2$" can be considered to be a width or length dimension of the aperture cross-section in the embodiment shown, however, second dimension $d_2$ is larger than the first diameter $d_1$ of the plurality of apertures 212 of gas generant segments 210. The centrally disposed aperture 232 may be sized to receive a pin, squib, an auto-ignition material or other componentry within the inflator assembly, as is well known in conventional designs.

In yet another variation, FIGS. 4A-4B show a segmented gas generant grain assembly 400 according to certain variations of the present disclosure. FIG. 4A shows a single symmetric high density pressed gas generant piece or segment 410, while FIG. 4B shows six symmetric gas generant segments 410A-410F circumferentially assembled into the single gas generant grain assembly 400 having a substantially round shape. Each gas generant segment 410 has a symmetric shape. In FIG. 4A, the each gas generant segment 410 has 3 rounded sides 414. The shape of gas generant segment 410 has one axis of symmetry, namely along the y-axis defined by the generally rounded triangular shape.

The gas generant segment 410 comprises at least one void having a first dimension and more specifically at least two or more apertures 412 having a first diameter ($d_1$). In gas generant segment 410, three distinct apertures 412 are formed in a body region 416. The apertures 412 are disposed within body region 416 at equal distances from one another. The apertures 412 are substantially round. Furthermore, the gas generant segment 410 defines at least two contact sides 420 having a complementary shape to assemble to adjacent gas generant segments.

Thus, the plurality of symmetric segments 410A-410F can be assembled together in a circumferential pattern to form a closed substantially round shape. Contact side 420A of gas generant segment 410A meets contact side 420F of gas generant segment 410F, while another contact side 420A of gas generant segment 410A meets and interfaces with contact side 420B of gas generant segment 410B on a second opposite side. Thus, as shown, contact side 420E of gas generant segment 410E interacts with contact side 420F (of gas generant segment 410F) and contact side 420D (of gas generant segment 410D). Contact side 420D of gas generant segment 410D interacts with contact sides 420E (of gas generant segment 410E) and contact side 420C (of gas generant segment 410C). Similarly, contact side 420C of gas generant segment 410C interacts with contact side 420D (of gas generant segment 410D) and contact side 420B (of gas generant segment 410B). Contact side 420B of gas generant segment 410B interacts with contact side 420C (of gas generant segment 410C) and the other side of gas generant segment 410A at contact side 420A. As such, six gas generant segments 410A-410F are arranged together to define a ring or substantially round segmented body 430.

The substantially round segmented body 430 has a centrally disposed aperture 432 that defines a second diameter "$d_2$." Notably, the centrally disposed aperture 432 has a hexagonal star cross-sectional shape in FIG. 4B. Thus, the diameter "$d_2$" can be considered to be a width or length dimension of the aperture cross-section in the embodiment shown (e.g., the longest dimension across the aperture), however, second dimension $d_2$ is larger than the first diameter $d_1$ of the plurality of apertures 412 of gas generant segments 410.

FIG. 4C shows an alternative variation of a single symmetric gas generant segment or piece 450 similar to the gas generant segment 410 in FIG. 4A. The gas generant segment 450 has a symmetric triangular shape with three apertures 452 disposed therein. As shown, the symmetric gas generant segment has side surfaces 462 and an upper surface 464 (as well as a bottom surface not shown in FIG. 4C). The upper surface 464 of the gas generant segment 450 is contoured and thus has a plurality of surface projections 460 formed therein. The areas outside of the surface projections 460 thus form recessed regions 464 in the upper surface 464.

Such surface projections 460 on the upper surface 464 of the gas generant segments 450 define offsets or standoffs (when assembled into a stack of gas generant grain assemblies, like 500 in FIG. 5A or the plurality of distinct segmented gas generant grain assemblies 750 stacked in FIG. 6B) and thus serve to form spaces or gaps between stacked gas generant assemblies. These spaces can thus serve as gas flow passages facilitating combustion of the gas generant, especially in an inflator device. Furthermore, the surface projections 460 may have a variety of shapes and are not limited by those shown in FIG. 4C. Thus, the surface projections 460 may have different shapes or differ in placement from the design shown in FIG. 4C. In certain aspects, the pattern of surface projections 460 formed on upper surface 464 is such that other gas generant segments stacked above the gas generant segment 450 preferably maintain an offset that permits fluid communication between gas generant segments when assembled by self-orientation into a segmented gas generant grain assembly stack.

Surface projections 460 are only formed on the upper surface 464 in FIG. 4C. However, in certain alternative embodiments, similar surface projections (additional protrusions or recessed regions) may also be placed on a bottom surface (not shown) or on one or more side surfaces 462, so long as they do not undesirably impact symmetry of the segments or the arrangement and contact between adjacent segments.

Suitable examples of gas generant compositions for forming the plurality of gas generant segments are selected to have adequate burn rates, density, and gas yield. For example, suitable gas generant compositions may include described in U.S. Pat. No. 6,958,101, to Mendenhall, et al. and U.S. Pat. Nos. 7,758,709, and 8,057,610, to Hussey et al ., the disclosure of which is herein incorporated by reference in its entirety.

In various embodiments, the gas generant comprises at least one fuel. The fuel component may be a nitrogen-containing compound and preferably is an azide-free compound. In certain aspects, suitable fuels include tetrazoles and salts thereof (e.g., aminotetrazole, mineral salts of tetrazole), bitetrazoles, 1,2,4-triazole-5-one, guanidine nitrate, nitro guanidine, amino guanidine nitrate, and the like. These fuels are combined with one or more oxidizers in order to obtain an acceptable burning rate and production of desirable gaseous species. For example, in certain variations, the gas generant may comprise guanidine nitrate as a fuel. Examples of suitable acidic organic compounds include, but are not limited to, tetrazoles, imidazoles, imidazolidinone, triazoles, urazole, uracil, barbituric acid, orotic acid, creatinine, uric acid, hydantoin, pyrazoles, derivatives and mixtures thereof. Particularly suitable acidic organic compounds include tetrazoles, imidazoles, derivatives and mixtures thereof. Examples of such acidic organic compounds include 5-amino tetrazole, bitetrazole dihydrate, and nitroimidazole. According to certain aspects, a preferred acidic organic compound includes 5-amino tetrazole.

In other embodiments, a substituted basic metal nitrate can include a reaction product formed by reacting an acidic organic compound with a basic metal nitrate. Examples of suitable acidic organic compounds include, but are not limited to, tetrazoles, imidazoles, imidazolidinone, triazoles, urazole, uracil, barbituric acid, orotic acid, creatinine, uric acid, hydantoin, pyrazoles, derivatives and mixtures thereof. Examples of such acidic organic compounds include 5-amino tetrazole, bitetrazole dihydrate, and nitroimidazole. Generally, suitable basic metal nitrate compounds include basic metal nitrates, basic transition metal nitrate hydroxy double salts, basic transition metal nitrate layered double hydroxides, and mixtures thereof. Suitable examples of basic metal nitrates include, but are not limited to, basic copper nitrate, basic zinc nitrate, basic cobalt nitrate, basic iron nitrate, basic manganese nitrate and mixtures thereof. One particularly preferred gas generant composition includes about 5 to about 60 weight % of guanidine nitrate co-fuel and about 5 to about 95 weight % substituted basic metal nitrate. However, any suitable fuels known or to be developed in the art that can provide gas generants having the desired burn rates, gas yields, and density described below are contemplated for use in various embodiments of the present disclosure.

The desirability of use of various co-fuels, such as guanidine nitrate, in the gas generant compositions is generally based on a combination of factors, such as burn rate, cost, stability (e.g., thermal stability), availability and compatibility (e.g., compatibility with other standard or useful pyrotechnic composition components). Fuel components may be respectively present in an amount of less than or equal to about 75% by weight of the gas generant composition; optionally less than or equal to about 50% by weight; optionally less than or equal to about 40% by weight; optionally less than or equal to about 30% by weight; and in certain aspects, optionally less than or equal to about 25% by weight of the gas generant composition.

As appreciated by those of skill in the art, such fuel components may be combined with additional components in the gas generant, such as co-fuels or oxidizers. One or more co-fuel/oxidizers are selected along with the fuel component to form a gas generant that upon combustion achieves an effectively high burn rate and gas yield from the fuel. The gas generant may include combinations of oxidizers. Suitable oxidizers for the gas generant composition include, by non-limiting example, alkali (e.g., elements Group 1 of IUPAC Periodic Table, including Li, Na, K, Rb, and/or Cs), alkaline earth (e.g., elements of Group 2 of IUPAC Periodic Table, including Be, Mg, Ca, Sr, and/or Ba), and ammonium nitrates, nitrites, and perchlorates; metal oxides (including Cu, Mo, Fe, Bi, La, and the like); basic metal nitrates (e.g., elements of transition metals of Row 4 of IUPAC Periodic Table, including Mn, Fe, Co, Cu, and/or Zn); transition metal complexes of ammonium nitrate (e.g., elements selected from Groups 3-12 of the IUPAC Periodic Table); and combinations thereof.

In certain variations, an oxidizer for the gas generant material may comprise a basic metal nitrate. Generally, suitable compounds include basic metal nitrates, basic transition metal nitrate hydroxy double salts, basic transition metal nitrate layered double hydroxides, and mixtures thereof. Thus, suitable oxidizers for the gas generant compositions may include, by way of non-limiting example, basic metal nitrates (e.g., elements of transition metals of Row 4 of IUPAC Periodic Table, including Mn, Fe, Co, Cu, and/or Zn). Suitable examples of basic metal nitrates include, but are not limited to, basic copper nitrate, basic zinc nitrate, basic cobalt nitrate, basic iron nitrate, basic manganese nitrate and mixtures thereof. Ammonium dinitramide is another suitable oxidizing agent. Such oxidizing agents may be respectively present in an amount of less than or equal to about 95% by weight of the gas generant composition; optionally less than or equal to about 75% by weight; optionally less than or equal to about 50% by weight; optionally less than or equal to about 25% by weight; optionally less than or equal to about 20% by weight; and in certain aspects, less than or equal to about 15% by weight of the gas generant composition.

The gas generant composition may comprise an oxidizer comprising a perchlorate-containing compound, in other words a compound including a perchlorate group ($ClO_4^-$). As noted above, in certain variations, the gas generant compositions are substantially free of perchlorate-containing compounds. However, if such perchlorate-containing compounds are present, alkali, alkaline earth, and ammonium perchlorates are contemplated for use in gas generant compositions. Particularly suitable perchlorate oxidizers include alkali metal perchlorates and ammonium perchlorates, such as ammonium perchlorate ($NH_4ClO_4$), sodium perchlorate ($NaClO_4$), potassium perchlorate ($KClO_4$), lithium perchlorate ($LiClO_4$), magnesium perchlorate ($Mg(ClO_4)_2$), and combinations thereof. If perchlorate oxidizers are present in the gas generant, it is preferably at less than about 20% by weight. By way of example, a perchlorate containing oxidizer is present in certain embodiments at about 0.5% to about 20% by weight; optionally about 0.5 to about 15% by weight; optionally about 1 to about 5% by weight of the gas generant.

If desired, a gas generant composition may optionally include additional components such as slag forming agents, coolants, flow aids, viscosity modifiers, pressing aids, dispersing aids, phlegmatizing agents, excipients, burn rate modifying agents, and mixtures thereof. Such additives typically function to improve the stability of the gas generant material during storage; modify the burn rate or burning profile of the gas generant composition; improve the handling or other material characteristics of the slag, which remains after combustion of the gas generant material; and improve ability to handle or process pyrotechnic raw materials.

For example, the gas generant compositions may optionally include a slag forming agent, such as a refractory compound, e.g., aluminum oxide and/or silicon dioxide. Generally, such slag forming agents may be included in the gas generant composition in an amount of 0 to about 10 weight % of the gas generant composition.

Coolants for lowering gas temperature, such as basic copper carbonate or other suitable carbonates, may be added to the gas generant composition at 0 to about 20% by weight. Similarly, press aids for use during compression processing, as will be described in greater detail below, include lubricants and/or release agents, such as graphite, and can be present in the gas generant at 0 to about 2%. While in certain aspects, the gas generant compositions can be substantially free of polymeric binders, in certain alternate aspects, the gas generant compositions optionally comprise low levels of certain acceptable binders or excipients to improve crush strength, while not significantly harming effluent and burning characteristics. Such excipients include microcrystalline cellulose, starch, carboxyalkyl cellulose, e.g., carboxymethyl cellulose (CMC), by way of example. When present, such excipients can be included in alternate gas generant compositions at less than 10% by weight, preferably less than about 5% by weight, and more preferably less than about 2.8%. Additionally, certain ingredients can be added to modify the burn profile of the pyrotechnic fuel material by modifying pressure sensitivity of the burning rate slope. One such example is copper bis-4-nitroimidazole. Agents having such an affect are referred to herein as pressure sensitivity modifying agents and they can be present in the gas generant at 0 to about 10% by weight. Such additives are described in more detail in U.S. Pat. No. 7,470,337 to Mendenhall et al. Other additives known or to be developed in the art for pyrotechnic gas generant compositions are likewise contemplated for use in various embodiments of the present disclosure.

In certain variations, a gas generant segment can be formed from a powder gas generant material. Powder preparation and processing may be conducted by creating a slurry distributing and thoroughly mixing several raw material components in water and/or a hydrophilic solvent, which may be followed by drying (e.g., spray drying). Such processes for forming powderized and/or granulated gas generants are merely exemplary and are well known to those of skill in the art. In certain aspects, the gas generant materials are in a dry powderized and/or pulverized form. The powderized materials can be placed in a die or mold, where an applied force compresses the gas generant materials to form a desired grain segment shape. The dry powders are optionally compressed with applied forces greater than about 50,000 psi (approximately 350 MPa), preferably greater than about 60,000 psi (approximately 400 MPa), more preferably greater than about 65,000 psi (approximately 450 MPa), and an in certain variations, greater than about 70,000 psi (approximately 483 MPa). In certain variations, a press force to apply to the dry powders in a die is greater than or equal to about 60,000 psi (approximately 400 MPa) to less than or equal to about 70,000 psi (approximately 483 MPa).

The formation of the smaller pressed grain segments improves robustness and also reduces high costs associated with manufacturing conventional unitary pressed monolithic gas generant grains. For example, lower cost manufacturing is realized in accordance with certain aspects of the present technology, because gas generant grain segments can be pressed on smaller, high-speed rotary presses. Conventional unsegmented monolithic grains have a large surface area and therefore require pressing on a hydraulic press to meet the press force requirements outlined above. Large hydraulic presses typically have processing speeds of about 4 to 6 strokes per minute. The gas generant segments prepared in accordance with the present disclosure have lower surface areas as compared to monolithic unsegmented gas generant grains and thus can be pressed on rotary tablet presses. Such rotary tablet presses have significantly greater processing speeds as compared to large hydraulic presses, for example, having processing speeds of up to 150 strokes per minute. Thus, even though a greater number of the smaller grain segments need to be pressed to form a larger grain assembly, the overall output on a rotary press is much higher (e.g., 4-12 times faster). Thus, manufacturing of smaller gas generant grain segments is significantly faster.

In various aspects, gas generant grain segments are compressed and in certain aspects, optionally have an actual density that is greater than or equal to about 90% of the maximum theoretical density. In certain aspects of the present disclosure, the actual density is greater than or equal to about 93%, optionally greater than about 95% of the maximum theoretical density, and optionally greater than about 97% of the maximum theoretical density. In certain aspects, the actual density of the gas generant grain segment exceeds about 98% of the maximum theoretical density of the gas generant material. Such high actual mass densities in gas generant materials are obtained in certain methods of forming gas generant grain assemblies in accordance with various aspects of the present disclosure, where compressive force is applied to gas generant raw materials that are substantially free of binder.

In certain aspects, it is preferred that a loading density of the gas generant segment is relatively high. A loading density is an actual volume of generant material divided by the total volume available for the shape (here of the segment). In accordance with various aspects of the present disclosure, it is preferred that a loading density for the gas generant segment is greater than or equal to about 50% and in certain variations is optionally greater than or equal to about 55%. In certain aspects, a gas generant segment has loading density of about 55 to about 63%.

Various aspects of the present disclosure provide a segmented gas generant having a shape (when the various gas generant segments are assembled together) that is tailored to create rapid heated gas. The overall grain assembly shape of the assembled gas generant segments has a desired surface area and shape to facilitate prolonged reaction and to create preferred gas production profiles at the desired pressures. The absence of the binder in certain embodiments from the gas generant segments further enables development of desirable burn and pressure profiles, as compared to conventional extruded gas generants. It is the combination of the selected gas generant material composition, initial surface area, shape, and density of the gas generant grain segments, when assembled together to form the overall segmented gas generant assembly shape, that maximizes desired combustion performance.

In certain aspects, the segmented gas generant has a shape that provides increasing surface area as the grain assembly burns. The desired shape of the segmented gas generant grain assembly formed of a plurality of symmetric pressed gas generant segments is linked to ballistic characteristics of the composition. The shape of the segmented gas generant grain assembly augments and controls the burn rate of the gas generant composition. In various aspects, a desirably high burning rate enables desirable pressure curves for inflation of an airbag. In this regard, an initial surface area of the segmented gas generant grain assembly is relatively low as compared to surface areas of traditional pellets and/or wafers; however, as the grain assembly shapes are burned, more surface area is progressively exposed, thus the amount of the composition combusting progressively becomes greater and generates a higher quantity of gas.

In accordance with certain aspects of the present disclosure, the segmented gas generant grain assembly has a linear burn rate of greater than or equal to about 1.0 inches per second (about 38.1 mm per second) at a pressure of about 3,000 pounds per square inch (about 20,865 kPa). In certain aspects, the segmented gas generant has a linear burn rate of greater than or equal to about 1.1 inches per second (about 28 mm/Sec); optionally greater than or equal to about 1.5 inches per second (about 38 mm/Sec); and optionally greater than or equal to about 1.9 inches per second (about 48 mm/Sec) at a pressure of about 3,000 pounds per square inch (psi) (about 20.7 MPa). In certain embodiments, the linear burn rate of the segmented gas generant is greater than or equal to about 2.0 inches per second (about 51 mm/Sec) at a pressure of about 3,000 psi (about 20.7 MPa). In certain embodiments, the burning rate of the segmented gas generant is less than or equal to about 2.1 inches per second (about 53 mm/Sec) at a pressure of 3,000 psi (about 20.7 MPa).

Additionally, in certain aspects, the gas generant segments that form the segmented gas generant grain assembly have a high mass density. For example, in certain embodiments, each gas generant segment has a theoretical mass density of greater than about 1.9 g/cm$^3$, preferably greater than about 1.94 g/cm$^3$, and even more preferably greater than or equal to about 2.12 g/cm$^3$.

Further, in accordance with the present disclosure, the gas yield of the segmented gas generant assembly is relatively high. For example, in certain embodiments, the gas yield is greater than or equal to about 2.4 moles/100 grams of gas generant. In other embodiments, the gas yield is greater than or equal to about 2.5 moles/100 g of the gas generant assembly. In certain embodiments, the gas yield is greater than or equal to about 3 moles/100 g of the gas generant assembly; optionally greater than or equal to about 3.1 moles/100 g of the gas generant assembly; and optionally greater than or equal to about 3.2 moles/100 g of the gas generant assembly.

Expressed in another way, the amount of gas produced for a given mass of gas generant present at a specific volume is relatively high. In this regard, the product of gas yield and density is an important parameter for predicting performance of the gas generant assembly. A product of gas yield and density (of the gas generant assembly) may be greater than about 5.0 moles/100 cm$^3$, and optionally greater than about 5.2 moles/100 cm$^3$, in various embodiments.

In certain alternative variations of the present disclosure, one of the pressed segments may be formed of a pyrotechnic material having a distinct composition than the other gas generant segments. By "distinct" it is meant that the first composition differs from the second composition by at least one component and preferably exhibits a material difference in pyrotechnic characteristics. For example, in certain variations, one of the pressed gas generant segments may comprise an auto-ignition material.

An auto-ignition agent is a material that spontaneously combusts at a pre-selected temperature, preferably a temperature lower than that which would lead to catastrophic failure in a gas generant system, such as potential explosion, fragmentation, or rupture of the airbag inflator upon exposure to extreme heat in excess of normal operating condition temperatures. In current systems, these temperatures may range from about 135° C. to greater than about 200° C. The auto-ignition material ignites the booster/initiator composition and/or gas generant resulting in the safe functioning of the gas generant at elevated temperatures. Thus, the gas generant may be ignited by two separate pathways, which include the igniter and the auto-ignition material, enabling safe gas generant deployment during abnormal conditions. Such an auto-ignition material can also be employed to increase the burning of the gas generant during normal operating conditions, in effect, operating as a booster composition. Further, the auto-ignition material may improve coupling of certain pyrotechnic materials to one another.

An auto-ignition material may comprise a single auto-ignition agent or a mixture of agents formulated to auto-ignite at a desired pre-selected temperature. Some examples of suitable auto-ignition materials known in the art include silver nitrate and smokeless powders, such as those sold by E. I. DuPont De Nemours under the Trade Name IMR 4895™. Other examples of suitable auto-ignition materials include those disclosed in U.S. Patent Publication No. 2006/0102259 to Taylor et al., which is herein incorporated by reference in its entirety and describes an auto-ignition material comprising a mixture of azodicarbonamide (ADCA) fuel and basic copper nitrate (BCN) oxidizer.

Initiator or booster fuels may also be included in a pyrotechnic material of such an alternative embodiment. Such booster materials include ethyl cellulose, nitrocellulose, metal hydride pyrotechnic materials such as zirconium hydride potassium perchlorate (ZHPP) and titanium hydride potassium perchlorate (THPP), zirconium potassium perchlorate (ZPP), boron potassium nitrate ($BKNO_3$), cis-bis-(5-nitrotetrazolato)tetramine cobalt(III)perchlorate (BNCP), and mixtures thereof. Some of these booster fuels, such as ethyl cellulose, may require the inclusion of an oxidizer. Such booster or initiator fuels can be present in an amount of less than or equal to about 50 weight % of the alternative pyrotechnic composition. Thus, the inventive technology permits more flexibility in gas generant grain assembly design. Such flexibility in design significantly improves bonfire test performance, but does not significantly degrade inflator performance.

For example, the inclusion of booster materials in a gas generant grain assembly can reduce or eliminate the need for an extensive igniter system. Similarly, inclusion of auto-ignition materials in a single pyrotechnic material grain assembly can streamline the architecture of the systems equipment by eliminating the need for separate containment of auto-ignition materials. Thus, the flexibility provided by the principles of the present disclosure provide the potential to reduce and/or eliminate complex hardware and staging systems, while further potentially avoiding safety and performance complications via the use of the improved pyrotechnic materials in a single unitary structure according to various embodiments of the present disclosure.

FIGS. 5A-5E show methods of assembling symmetric gas generant segments pressed as described above into segmented gas generants according to certain aspects of the present disclosure. With reference to FIG. 5A, an exploded view of having a gas generant grain stack 500, including three distinct segmented gas generant grain assemblies 510 to be stacked on top of one another in layers and to be disposed on a strainer component 520 formed by an assembly process according to certain aspects of the present disclosure illustrated in FIGS. 5B-5E. Strainer component 520 includes a lower metal disc 522 having multiple openings 524 to permit fluid flow therethrough. Strainer component 520 also comprises an upwardly extending or protruding central pin 526. The strainer component 520 is thus capable of receiving and retaining the stack of segmented gas generant grain assemblies 510.

The distinct segmented gas generant grain assemblies 510 have a design like the previously described embodiment shown in FIGS. 2A-2B. Each gas generant grain assembly 510 is formed of a plurality (i.e., three) of pressed symmetric high density gas generant segment grains 530 that are arranged together circumferentially in contact with one another along contact surfaces 532 to define a body 534 having a substantially round shape. Each gas generant segment grain 530 comprises a plurality of voids or apertures 536, while the substantially round gas generant body 534 has a centrally disposed aperture 540 that is sized to receive central pin 526 of strainer component 520. The strainer component 520 having the gas generant body 534 disposed thereon is thus capable of being transferred and incorporated directly into an inflator assembly of an inflatable restraint device. Certain advantages of the use of symmetric gas generant segments according to the inventive technology may be illustrated by the assembly process for manufacturing progressively shown in FIGS. 5B-5E.

Figure 5B:
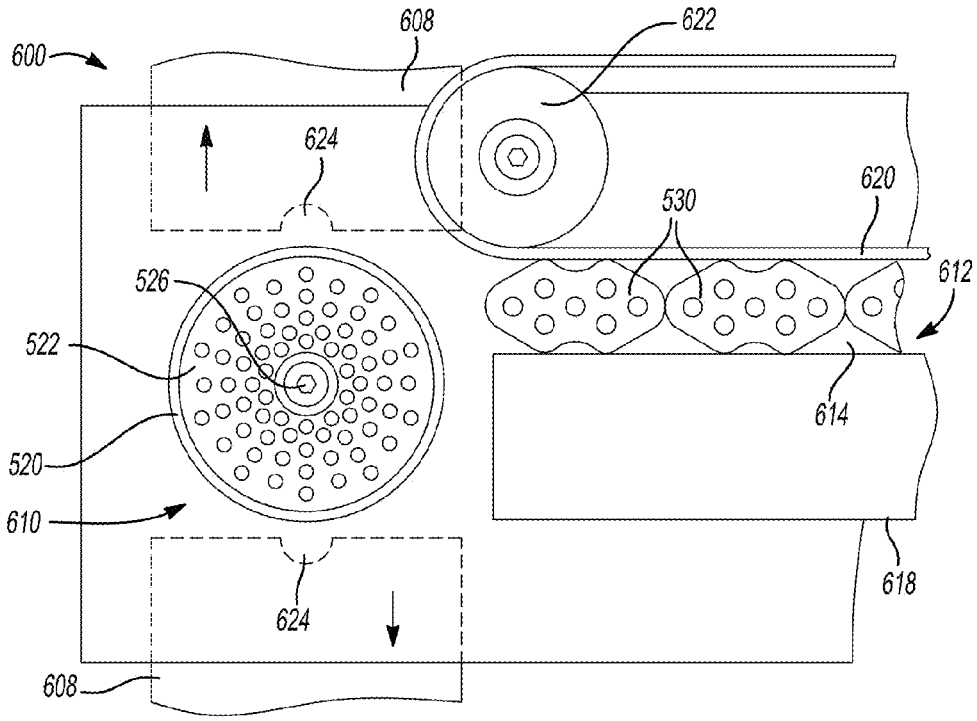

An exemplary gas generant assembly device 600 in accordance with certain aspects of the present technology is shown in FIGS. 5B-5E. In certain aspects, a process of forming a segmented gas generant can be continuous and automated, although in alternative aspects, may also be conducted manually. In FIG. 5B, to initiate the process, two plates 608 on a receiving zone 610 of the assembly device 600 are slid in opposite directions so that a strainer component 520 (like that in FIG. 5A) is seated within the receiving zone 610 of the assembly device 600. A feeding zone 612 is shown on an opposite side of the sectional assembly device 600 (the actual region for introducing pressed symmetric gas generant segment grains 530 into the conveyor track 614 is not shown FIGS. 5A-5B, but as appreciated by those of skill in the art is upstream of the loading zone 612). The pressed symmetric gas generant segment grains 530 are fed on a conveyor track 614. The conveyor track 614 includes a track wall 618 to align the gas generant segment grains 530. On the other side of the conveyor track 614, a side-mounted conveyor belt 620 moves clockwise about a first roller 622 and a second roller (not shown). The conveyor belt 620 may be automated or alternatively may be manually operated. The conveyor belt 620 can be formed of a material that enhances traction and grip on the adjacent gas generant segment grains 530 as they move through the conveyor track 614. For example, the conveyor belt 620 can be formed of a ribbed or patterned rubber belt, as are well known in the art.

Before the first gas generant segment grains 530 are translated down the conveyor track 614 to the receiving end 610, plates 608 are closed together over the lower metal disc 522. Notably, plates 608 have hemispherical regions 624 at the mating edges that together form an opening for the central pin 526 of the strainer component 520 that protrudes during loading of the gas generant segments 530.

Figure 5C:
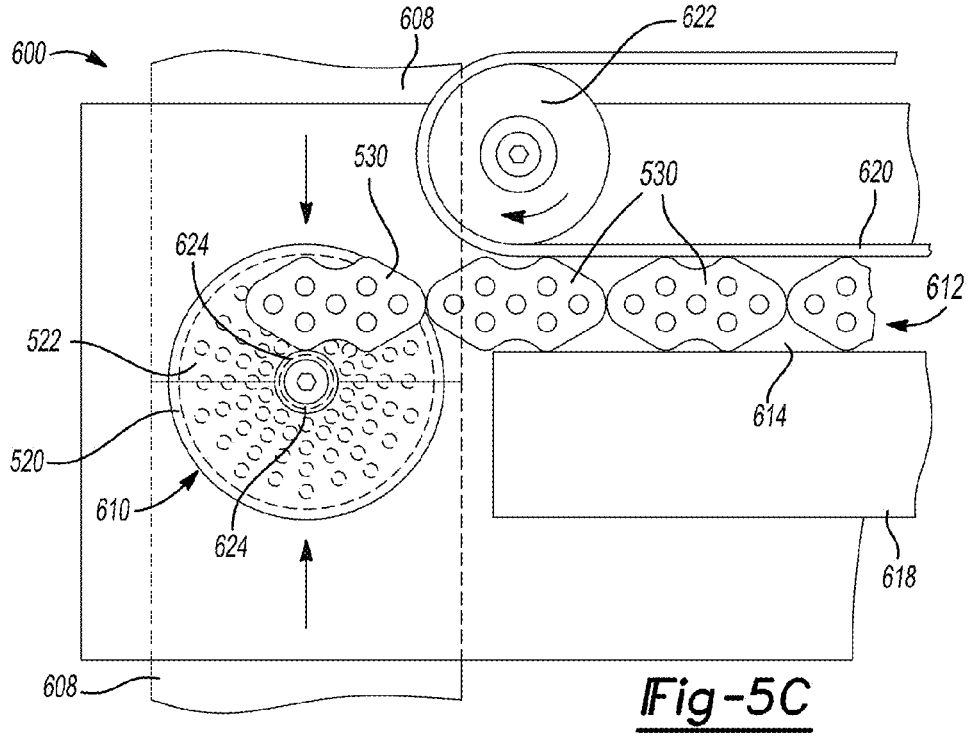
Figure 5D:
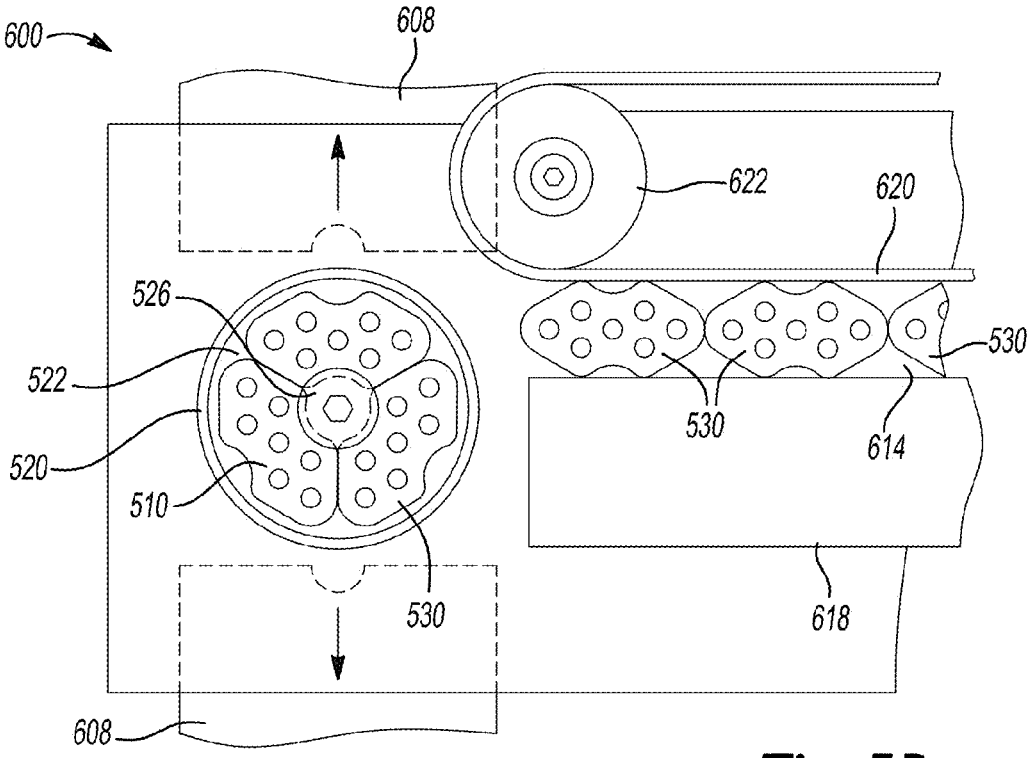

As shown in FIG. 5C, a first gas generant segment 530 is translated from the feeding zone 612 through the conveyor track 614 via clockwise movement of the conveyor belt 620 and enters the receiving zone 610. The first gas generant segment 530 is slid over the plates 608 for loading around the central pin 526 of the strainer component 520. Notably, the plates 608 have a depth that creates a recessed region in which the gas generant segment grains 530 can be contained as they enter the receiving zone 610. The feeding of the gas generant segment grains 530 into the recessed region formed by the plates 608 arranges the respective grain segments in a circumferential pattern about the central pin 526. After three symmetric gas generant segment grains 530 are loaded into the receiving zone 610 over the plates 608 (see FIG. 5D), the conveyor belt 620 movement is momentarily stopped. The plates 608 onto which the three gas generant segment grains 530 are loaded and then withdrawn outwards, so that the seated gas generant segments 530 drop down onto the lower metal disc 522 of strainer component 520. As can be seen, a first segmented body of a gas generant grain assembly 510 (like in FIG. 5A) having a substantially round body is thus formed. Because symmetric grain segments tend to self-orient into the larger round grain assembly shape when loaded down a track, the inventive technology simplifies and streamlines the loading and manufacturing process significantly.

Figure 5E:
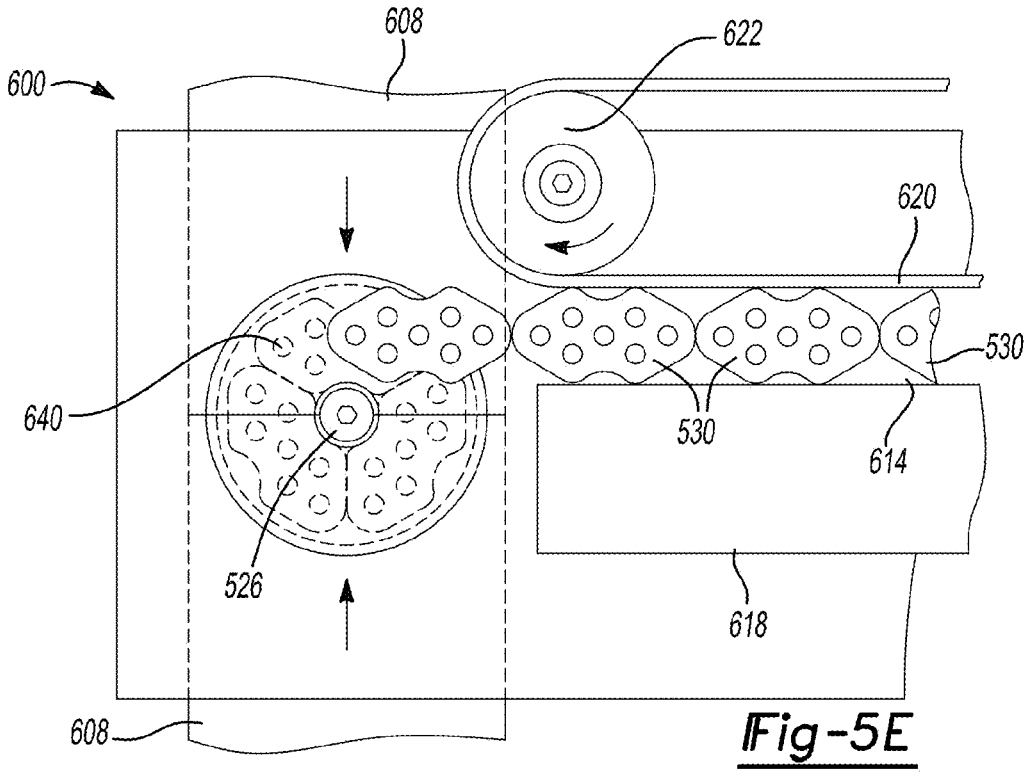

The process can then be repeated as many times as necessary to form multiple gas generant grain assembly bodies 510 forming distinct layers, such as shown in FIG. 5A. Thus, in FIG. 5E, a second segmented body of a gas generant grain assembly is formed, where the plates 608 are closed around central pin 526 and over the first gas generant grain assembly 510. The next symmetric gas generant segment grains 530 are translated by recommencing operation of the conveyor belt 620. In FIG. 5E, a first gas generant grain 530 is loaded over plate 608 in the recessed region about central pin 526. The process is repeated as described above in the context of FIGS. 5C-5D, so that once three distinct symmetric gas generant segments 530 are placed, the plates 608 may be drawn outward to permit the second segmented gas generant grain assembly to drop and rest in contact with the underlying first segmented gas generant grain assembly 510. This process may be repeated as many times as desired to form a stack 500 of distinct segmented gas generant grain assembly bodies. Thus, when the segmented gas generant grain assembly bodies in FIG. 5A are assembled together, three distinct layers of gas generant grain assemblies 510 form a stack structure 500 over the lower metal disc 522 of the strainer component 520. This assembly process may be used as many times as necessary to form multi-layer or single layer segmented gas generant grain assemblies having a substantially round shape. As appreciated by those of skill in the art, the strainer component is merely exemplary of one embodiment for seating the gas generant grain assemblies, but other structures and methods for holding the segmented gas generant assemblies are likewise contemplated.

In certain preferred variations, the symmetric segments may not be physically connected or attached together, but rather just placed into near proximity and/or contact with other adjacent segments and retained in place by a strainer component or other holding receptacle or structure. This provides certain advantages, such as avoiding introducing additional materials to the gas generant grain assembly during combustion and improved burn profiles. However, in certain alternative embodiments, such as that shown in FIGS. 6A and 6B, gas generant grain assemblies according to certain alternative variations of the present disclosure may be physically attached, connected, or otherwise coupled together.

In FIG. 6A, a gas generant grain assembly 700 has a design like the embodiment previously described in FIGS. 3A-3B. Thus, the gas generant grain assembly 700 comprises four pressed gas generant segments 710 defining a symmetric shape, each of the gas generant segments 710 having a plurality of voids or apertures 712 and sides 720 for interfacing with adjacent gas generant segments 710. Disposed between each respective gas generant segment 710 along the sides 720 is a binder or adhesive 722. The binder or adhesive may be selected from a group consisting of: cyanoacrylates, epoxy resins, natural adhesives (e.g., starch-based adhesives), ultraviolet curable adhesives, such as acrylates, and any combinations or equivalents thereof. If such a binder or adhesive 722 is employed, it is selected to minimize generation of undesirable effluent species during combustion of the gas generant composition. In this manner, the gas generant segments 710 are not only arranged together circumferentially, but also physically coupled to one another to form the segmented gas generant grain assembly 700.

FIG. 6B shows yet another alternative variation of a segmented gas generant grain assemblies according to certain variations of the present disclosure that are physically connected or coupled together. FIG. 6B shows a plurality of distinct segmented gas generant grain assemblies 750 stacked together similar to the embodiment in FIG. 5A. Each gas generant grain assembly 750 comprises four pressed gas generant segments 760 defining a symmetric shape, each of the segments 760 having a plurality of voids or apertures 762 and sides 764 for interfacing with adjacent gas generant segments 760. In this embodiment, a sleeve or band 770 is disposed around an outside perimeter or surface 772 of each of the gas generant segment grain assemblies 750 of the stack to hold the assembly together. The sleeve or band 770 may be formed of a metal or a polymer, such as an elastomer. For example, in certain variations, each gas generant segment comprises an adhesive disposed between at least two complementary sides of adjacent gas generant segments. In other variations, an outer band may surround the plurality of gas generant segments to attach them together. For example, each gas generant segment may be coupled to adjacent gas generant segments by an outer circumferential band disposed about a perimeter of the segmented gas generant. Furthermore, the band 770 may be used on a single layer segmented gas generant 750 and may have different dimensions (e.g., may be narrower). Again, selection of the materials for the band 770 preferably minimizes generation of undesirable effluent species during combustion of the gas generant composition. The band may be formed of a material selected from a group consisting of: natural rubber, molded plastics, tape, such as pressure sensitive adhesive backed paper, fabric, or metal foil, and any combinations or equivalents thereof.

In yet another embodiment, shown in FIG. 10, an alternative variation of a single symmetric gas generant segment or piece 810 is shown. The single symmetric gas generant segment 810 comprises a gas generant material and is pressed to form a small high density grain. While not shown, symmetric gas generant segments like 810 can be assembled in a circumferential pattern into a single gas generant grain assembly having a substantially round shape, similar to that shown in FIG. 2B. The shape of gas generant segment 810 has two axes of symmetry, namely along the x-axis and the y-axis defined by the generally oblong oval shape, having four sides 814 interspersed with two concave side regions 818 defined therein (e.g., having a peanut shape). At least two of these sides 814 serve as a contact side having a complementary shape to adjacent gas generant segments.

The gas generant segment 810 comprises at least one void having a first dimension, more specifically at least two or more apertures 812 having the first diameter ("$d_1$"). In gas generant segment 810, three distinct apertures 812 are formed in a body region 816. The apertures 812 are disposed within body region 816 at equal distances from one another and notably, like the symmetric overall shape of the gas generant segment 810, are disposed symmetrically within the body region 816 of the gas generant segment 810. The apertures 812 are substantially round, thus forming cylindrical openings through body region 816. Like, the previous embodiments, while not shown, variations in dimensions, shape, and distribution of voids (e.g., apertures 812) with the body region 816 are contemplated. A plurality of symmetric gas generant segments 810 can be assembled together in a circumferential pattern to form a closed substantially round shape, in accordance with the assembly patterns shown in the previous embodiments.

Notably, an upper surface 820 of the gas generant segment 810 is contoured and thus defines a plurality of surface projections 822. The areas outside of the surface projections 822 thus define recessed regions 824 in the upper surface 820. Such surface projections 822 on the upper surface 820 of the gas generant segment 810 define offsets or standoffs creating spaces or gaps between stacked gas generant assemblies. Such spaces can thus serve as gas flow passages facilitating combustion of the gas generant, especially in an inflator device.

Notably, the surface projections 822 may be selectively placed in other locations on the upper surface 820 and may have different shapes from those shown in FIG. 10. In certain aspects, the pattern of surface projections 822 and recessed regions 824 formed on upper surface 820 is such that regardless of the position during the self-orientation process of other gas generant segments (having the same surface profile pattern), the stacked gas generant segments 810 will still form an offset that permits fluid communication when the segments are stacked on top of one another. Thus, the pattern shown in FIG. 10 has a plurality of parallel surface projections 822 and recessed regions 824 formed at an angle (e.g., approximately 60°) across the upper surface 820, minimizing the ability for adjacent upper and lower segments to have aligned or mating recessed and protruding regions that might eliminate the desired offsets and attendant fluid flow pathways.

Further, while surface projections 822 and recessed regions 824 are only formed on the upper surface 820 in FIG. 10, in certain alternative embodiments, similar surface contours (additional protrusions or recessed regions) may also be placed on a bottom surface (not shown) or on one or more side surfaces 814, so long as they do not undesirably impact symmetry of the segments or the arrangement and contact between adjacent segments.

The following non-limiting examples further illustrate certain aspects of the inventive technology.

EXAMPLE 1

In one example, a 5-amino tetrazole substituted basic copper nitrate fuel is formed. 72.7 lb. of 5-amino tetrazole is charged to 42 gallons of hot water to form a 5-amino tetrazole solution. 272.9 lb. of basic copper nitrate is slowly added to the 5-amino tetrazole solution. 5-aminotetrazole and basic copper nitrate are allowed to react at 90° C. until the reaction is substantially complete. To the reaction mixture are added 139.95 lb. of guanidine nitrate and 14.45 lb. of silicon dioxide. The slurried mixture is then spray dried. 5.1 lb. of a release agent (inert carbon, i.e., graphite) and 20.83 lb. of basic copper carbonate (a coolant) are dry blended with the spray dried composition.

EXAMPLE 2

A blended powder as prepared in Example 1 is placed in a pre-formed die having the desired shape to from a pressed gas generant grain segment as shown in FIG. 4A in accordance with certain aspects of the inventive technology. The die is sized to form a grain segment that fits inside an Ø37 mm inner diameter chamber. The grain segment has a surface area of 0.2 $in^2$ and thus requires a press capacity of about 9 tons (at max operating load of 80% of capacity) to achieve the target press force of about 70,000 psi (483 MPa). The die and powders are placed in a high speed rotary press having a capacity of 13 to 30 tons of compressive force. The raw materials are pressed to form a high density gas generant solid segment within the respective dies. Six such pressed gas generant grain segments are used to form Example A for purposes of comparison.

EXAMPLE 3

For purposes of comparison, a blended powder as prepared in Example 1 is placed in a pre-formed die having the desired shape to from pressed unitary unsegmented monolithic gas generant grains as shown in FIGS. 7A and 8A. The die and powders are placed in a large, high tonnage hydraulic press capable of exerting forces in excess of 50 tons. The grain in FIG. 7A is designed to fit inside a Ø37 mm inner diameter chamber. It has a surface area of 1 $in^2$ and requires a press capacity of about 44 tons (at max operating load of 80% of capacity) to achieve the target press force of 70,000 psi (483 MPa). The raw materials are pressed to form a high density gas generant solid within the respective dies.

Thus, for purposes of comparison, a conventional unsegmented single gas generant monolithic grain 800 having a shape shown in FIG. 7A is formed with the gas generant formed in Example 1 and will be designated Comparative Example B. As shown in FIG. 7A, this conventional gas generant monolithic grain 800 has an annular ring shape with a large centrally disposed aperture 810. The annular ring shape also has a fluted exterior circumference 812. A plurality of small apertures 814 having a circular cross-sectional shape is disposed within a body portion 816 of the annular ring shape of the conventional single gas generant monolithic grain 800.

Similarly, for purposes of comparison, a conventional single gas generant monolithic grain 850 having a shape shown in FIG. 8A is formed with the materials from Example 1 and will be designated Comparative Example C. As shown in FIG. 7A, this conventional gas generant monolithic grain 850 has an annular ring shape with a large centrally disposed aperture 860. A plurality of apertures 862 having a rectangular cross-sectional shape is disposed within a body portion 864 of the annular ring shape of the conventional single gas generant monolithic grain 850. The high density gas generant segment that is formed in this Example has a shape like gas generant grain 850. Thus, the gas generant grain 850 has a similar size and press requirement to the gas generant grain 800 in FIG. 7A described just above.

EXAMPLE 4

This example explores robustness of segmented gas generants formed in accordance with the present disclosure as compared to that of conventional unitary gas generant monolithic grains. A segmented gas generant grain prepared in accordance with certain aspects of the present disclosure, designated Example A, is compared to conventional single gas generant monolithic grains designated Comparative Example B (shown in FIG. 7A) and Comparative Example C (shown in FIG. 8A), respectively.

A drop test is conducted per U.S. Council for Automotive Research (USCAR) 5.2.4.8.6. More specifically, a horizontal drop test is used that includes disposing a stack of multiple layers of grains of the gas generant sample being tested under a tension within a simulated gas generator. Conical compression springs having a gap of 7 mm are used. The simulated gas generator holding the gas generant samples is then dropped on its side axis horizontally. Here, the horizontal drop test is conducted at a vertical height of 1.2 m (2 times on each axis) on a steel plate. The dropped samples are then removed from the simulated gas generator for assessment of any damage.

As can be seen in the photographs of the results of one horizontal drop test in FIGS. 7B and 8B, the pressed unsegmented monolithic grains in Comparative Examples B and C fail the drop test. Each of the monolithic grains in Comparative Example B was broken/fragmented into multiple pieces, while 3 of 5 of the monolithic grains in Comparative Example C were broken/fragmented. However, the segmented gas generant grain assembly in Example A shown in FIG. 9 passes the drop test without any fracturing or breakage. Thus, these drop test results show significant improvement in robustness for a segmented gas generant grain formed of a plurality of smaller symmetric gas generant segments as compared to a monolithic gas generant grain. As demonstrated by Example 4, smaller grain segments are much more robust that larger grains. It is believed that the smaller grain segments introduce multiple slip planes between grain segments to allow them to absorb energy and move without any actual breakage.

In multiple iterations of the horizontal drop tests, 16 of 19 of pressed unsegmented monolithic grains like those in Comparative Examples B and C failed the drop test by showing significant, extensive breakage and fracturing, thus having a rate of breakage of about 84%. However, in the same horizontal drop test, only 2 of 126 segmented gas generant grain assemblies like in Example A (having a 6-piece segmented gas generant grain assembly like in FIGS. 4A-4B) show minor breakage without fracturing. The rate of breakage for gas generant assemblies prepared in accordance with certain aspects of the present teachings is about 1.6%. Furthermore, the breakage in the 2 samples from the drop testing of grain assemblies (like in Example A) results in only minor chips and therefore these grain assemblies could still be used in the gas generator, as the minor chipping damage is not significant enough to alter inflator performance. In contrast, the extent of breakage of 16 of 19 monolithic gas generant grains (Comparative Examples B and C) after the drop testing would render them unacceptable for use in an inflator.

The segmented gas generant grain assemblies according to various aspects of the present teachings share various advantages with monolithic gas generant grains, such as repeatable and well controlled combustion, while avoiding certain potential disadvantages. For example, conventional pressed monolithic grains, like those in Comparative Examples B and C tend to be somewhat fragile. Thus, broken grains can occur during processing, shipping, or during the life of the product (after the grain has been loaded into an airbag inflator). Broken grains occurring during manufacturing results in increased cost due to product scrap. Broken grains during life cycle can potentially be a more serious issue, because a broken grain could potentially experience variability in performance.

In certain variations, a segmented body of a pressed gas generant grain assembly prepared in accordance with the present disclosure has a rate of breakage that is significantly less than a rate of breakage for a comparative monolithic non-segmented gas generant grain defining the same gas generant grain shape. In certain variations, a pressed segmented gas generant grain prepared in accordance with the present disclosure has a rate of breakage of less than or equal to about 50% of all pressed segmented gas generant grains tested; optionally less than or equal to about 25%; optionally less than or equal to about 15%; optionally less than or equal to about 10%; optionally less than or equal to about 5%; and optionally less than or equal to about 4%; optionally less than or equal to about 3%. In certain variations, a pressed segmented gas generant grain prepared in accordance with the present disclosure has a rate of breakage of less than or equal to about 2% of all pressed segmented gas generant grains tested. Further, enhanced robustness of a gas generant grain assembly reduces performance variability once the inflator assembly is in service within a vehicle.

The inventive gas generant designs provide yet other advantages over the conventional monolithic unitary body pressed gas generants. While forming a gas generant grain assembly of multiple pressed pieces might initially appear to add greater manufacturing complexity by having to form multiple pieces and the subsequent assemblage steps required, in various aspects, formation of small symmetric segments assembled into a larger segmented grain assemblies has significant advantages. First, the assembly of a plurality of symmetric gas generant segments arranged together circumferentially to define a segmented body of the pressed gas generant grain assembly actually has the potential to provide a lower cost manufacturing process. Large pressed monolithic grains require large press equipment (typically a hydraulic press) that is very expensive and often requires a slower cycle time, which in turn increases process costs. However, the small gas generant segments can be pressed to appropriate densities on smaller high-speed high through-put rotary presses, as compared to the relatively large pressed unitary body monolithic gas generant grains. Thus, despite the additional complexity of forming multiple pieces that have to be arranged and assembled together, the ability to form the smaller grain segments on smaller presses results in faster manufacturing. Further, the pressed gas generant segments having a symmetric shape are capable of self-orienting during manufacturing and assembly into a gas generant grain assembly, which likewise speeds manufacturing and reduces overall cost. Due to enhanced robustness and reduced fragility, less packaging is required to transport the gas generant assembly components, thus reducing packaging and shipping costs.

Additionally, small grain segments permit more flexibility in gas generant grain assembly design. For example, the inventive technology permits easier integration of other pyrotechnic materials, such as an auto-ignition material. One of the small grain segments can be replaced with a grain segment having the same shape, but made from a distinct pyrotechnic material, such as an auto-ignition material.

In various aspects, the present disclosure provides pressed gas generant grain assemblies, which are segmented, and thus comprise a plurality of symmetric gas generant pieces or segments. Each of the symmetric gas generant segments is pressed and comprises a gas generant material. The symmetric pieces or segments are arranged together circumferentially to define a segmented body of the pressed gas generant grain assembly. In certain aspects, the symmetric segments of the pressed segmented monolithic gas generant grain assemblies are substantially free of polymeric binder and have a high density. Such symmetric segment pieces may be formed in unique shapes to form monolithic gas generant grain assemblies that optimize the ballistic burning profiles of the materials contained therein. In forming a segmented pressed grain assembly in accordance with various aspects of the present teachings, a more robust and less expensive gas generant grain assembly having the desired performance properties is realized.

In certain variations, the present disclosure provides a segmented gas generant grain assembly comprising a plurality of gas generant segments arranged together circumferentially to define a segmented body of the gas generant grain assembly. Each gas generant segment is pressed and has a shape that is symmetric with respect to at least one axis defined by the segment. Further, each gas generant segment comprises at least one void having a first dimension. In certain variations, each gas generant segment comprises two or more apertures having a first dimension. The segmented body formed when the plurality of symmetric gas generant segments are assembled together has a central aperture having a second diameter or dimension greater than the first dimension.

In certain variations, a shape of each gas generant segment has not only one axis of symmetry, but rather two axes of symmetry, which correspond to an x-axis and a y-axis of the segment. In certain embodiments, the segmented body comprises 3 to 6 of the gas generant segments. In certain variations, each symmetric gas generant segment comprises at least one void, which may be an aperture extending through the gas generant segment body. In certain embodiments, each gas generant segment comprises 3 to 7 apertures, which have the first diameter or dimension. In certain aspects, the shape of the gas generant segment may define 3 to 6 sides. In certain other aspects, each gas generant segment defines at least two distinct sides for contacting adjacent sides of two distinct adjacent gas generant segments.

In certain alternative variations, each gas generant segment may be physically attached to an adjacent gas generant segment. For example, in certain variations, each gas generant segment comprises an adhesive disposed between at least two complementary sides of adjacent gas generant segments. In other variations, an outer band may surround the plurality of gas generant segments to attach them together. For example, each gas generant segment may be coupled to adjacent gas generant segments by an outer circumferential band disposed about a perimeter of the segmented gas generant. In other aspects, each symmetric gas generant segment may have a contoured surface having one or more recessed regions that form offsets for fluid flow between adjacent symmetric gas generant segments.

In certain aspects, the segmented body of the pressed gas generant grain assembly has a rate of breakage less than or equal to about 50%; optionally less than or equal to about 25%, optionally less than or equal to about 10%, optionally less than or equal to about 5%, and in certain variations, less than or equal to about 2% of all pressed gas generant grain assemblies tested. In yet other variations, one of the plurality of gas generant segments forming the segmented gas generant grain assembly has a pyrotechnic composition that is distinct from the others of the plurality of gas generant segments. For example, the distinct pyrotechnic composition may comprise an auto-ignition material.

In other aspects, the present disclosure provides a segmented gas generant grain assembly comprising a plurality of gas generant segments arranged together circumferentially to define a substantially round and segmented body of the gas generant grain assembly. Each gas generant segment in a final pressed form has an actual density of greater than or equal to about 95% of the maximum theoretical mass density. Further, each gas generant segment is substantially free of any binder and has a shape that is symmetric with respect to at least one axis defined by the segment. Further, each gas generant segment comprises at least one void having a first dimension. In certain variations, each gas generant segment comprises two or more apertures having a first dimension. Thus, gas generant segment optionally comprises at least two or more apertures having a first dimension or diameter. When the plurality of segments is assembled together, the substantially round and segmented body has a central aperture having a second diameter or dimension that is greater than the first diameter or dimension.

In certain variations, a shape of each gas generant segment has not only one axis of symmetry, but rather two axes of symmetry, which correspond to an x-axis and a y-axis of the segment. In certain variations, each symmetric gas generant segment comprises at least one void, which may be an aperture extending through the gas generant segment body. In certain embodiments, each gas generant segment comprises 3 to 7 apertures, which have the first diameter or dimension. In certain aspects, the shape of the gas generant segment may define 3 to 6 sides. In certain other aspects, each gas generant segment defines at least two distinct sides for contacting adjacent sides of two distinct adjacent gas generant segments.

In certain alternative variations, each gas generant segment is attached to an adjacent gas generant segment. For example, in certain variations, each gas generant segment comprises an adhesive disposed between at least two complementary sides of adjacent gas generant segments. In other variations, an outer band may surround the plurality of gas generant segments to attach them together. For example, each gas generant segment may be coupled to adjacent gas generant segments by an outer circumferential band disposed about a perimeter of the segmented gas generant. In other aspects, each symmetric gas generant segment may have a contoured surface having one or more recessed regions that form offsets for fluid flow between adjacent symmetric gas generant segments.

In certain aspects, the segmented body of the pressed gas generant grain assembly has a rate of breakage less than or equal to about 50%; optionally less than or equal to about 25%, optionally less than or equal to about 10%, optionally less than or equal to about 5%, and in certain variations, less than or equal to about 2% of all pressed gas generant grain assemblies tested. In yet other variations, one of the plurality of gas generant segments forming the segmented gas generant grain assembly has a pyrotechnic composition that is distinct from the others of the plurality of gas generant segments. For example, the distinct pyrotechnic composition may comprise an auto-ignition material.

In yet other variations of the present disclosure, methods of making segmented gas generant grain assemblies are provided. For example, one such method comprises conveying a plurality of gas generant segments to a round receptacle capable of receiving the gas generant segments. Each gas generant segment has a shape that is symmetric with respect to at least one axis defined by the segment. The method includes sequentially introducing the respective gas generant segments into the round receptacle, where each symmetric segment self-orients to be arranged circumferentially within the round receptacle to form a segmented gas generant grain assembly having a substantially round body. In certain variations, the method also comprises removing the segmented gas generant grain assembly thus formed from the round receptacle.

In certain aspects, prior to sequentially introducing the gas generant segments, a strainer component having a central protruding pin and a lower metal disc is disposed in the round receptacle. During the sequential introducing, the gas generant segments can be seated onto the lower metal disc around the central protruding pin disposed within the round receptacle. Thus, during the sequential introducing of the gas generant segments, each symmetric segment self-orients to be arranged circumferentially around the central protruding pin. Thus, the removing step further comprises removing both the segmented gas generant grain assembly and the strainer component.

In other aspects, the method may include repeating the conveying and sequentially introducing steps one or more times, before the removing occurs. In certain variations, the conveying and sequentially introducing is conducted multiple times to form a stack of distinct segmented gas generant grain assemblies, which are removed from the round receptacle.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is: ,

1. A segmented gas generant grain assembly comprising:

a plurality of gas generant segments arranged circumferentially to define a segmented body of the gas generant grain assembly, wherein each gas generant segment has a shape that is symmetric with respect to at least one axis defined by the segment and comprises at least one void having a first dimension, wherein the segmented body has a central aperture having a diameter greater than the first dimension;

wherein the segmented body of the gas generate grain has a rate of breakage less than or equal to about 50%.

2. The segmented gas generant grain assembly of claim 1, wherein the segmented body comprises 3 to 6 of the gas generant segments.

3. The segmented gas generant grain assembly of claim 1, wherein the shape of each gas generant segment has two axes of symmetry corresponding to an x-axis and a y-axis of the segment.

4. The segmented gas generant grain assembly of claim 1, wherein the at least one void in each gas generant segment is an aperture and each gas generant segment comprises 3 to 7 apertures having the first dimension.

5. The segmented gas generant grain assembly of claim 1, wherein the shape of the gas generant segment defines 3 to 6 sides.

6. The segmented gas generant grain assembly of claim 1, wherein each gas generant segment defines at least two distinct sides for contacting adjacent complementary sides of two distinct adjacent gas generant segments.

7. The segmented gas generant grain assembly of claim 1, wherein each gas generant segment is attached to an adjacent gas generant segment.

8. The segmented gas generant grain assembly of claim 7, wherein each symmetric gas generant segment has a contoured surface having one or more recessed regions that define offsets for fluid flow between adjacent gas generant segments.

9. The segmented gas generant grain assembly of claim 1, wherein the segmented body of the gas generant grain has a rate of breakage less than or equal to about 5%.

10. The segmented gas generant grain assembly of claim 1, wherein one of the plurality of gas generant segments has a pyrotechnic composition that is distinct from the others of the plurality of gas generant segments.

11. The segmented gas generant grain assembly of claim 10, wherein the pyrotechnic composition comprises an auto-ignition material.

12. The segmented gas generant grain assembly of claim 1, wherein the plurality of gas generant segments are arranged circumferentially to define a substantially round and segmented body of the gas generant grain assembly, wherein each gas generant segment has an actual density of greater than or equal to about 95% of a maximum theoretical mass density, is substantially free of any binder, has a shape that is symmetric with respect to at least one axis defined by the segment, and comprises at least two or more apertures having a first diameter.

13. The segmented gas generant grain assembly of claim 12, wherein substantially round and segmented body comprises 3to 6of the gas generant segments, wherein each gas generant segment comprises 3to 7apertures having the first diameter.

14. The segmented gas generant grain assembly of claim 12, wherein the shape of each gas generant segment has two axes of symmetry corresponding to an x-axis and a y-axis of the segment.

15. The segmented gas generant grain assembly of claim 12, wherein the segmented body of the gas generant grain assembly has a rate of breakage less than or equal to about 10%.

16. A method of making a segmented gas generant grain assembly, the segmented gas generant grain assembly including a plurality of gas generant segments arranged circumferentially to define a segmented body of the gas generant grain assembly, wherein each gas generant segment has a shape that is symetric with respect to at least one axis defined by the segment and comprises at least one void having a first dimension, wherein the segmented body has a central aperture having a diameter greater than the first dimension, the method comprising:

conveying the plurality of gas generant segments to a round receptacle;

sequentially introducing the gas generant segments into the round receptacle, wherein each symmetric segment self-orients to be arranged circumferentially within the round receptacle to form a segmented gas generant grain assembly having a substantially round body; and removing the segmented gas generant grain assembly from the round receptacle.

17. The method of claim 16, wherein prior to sequentially introducing the gas generant segments, a strainer component having a central protruding pin and a lower metal disc is disposed in the round receptacle, wherein the removing further comprises removing the segmented gas generant grain assembly and the strainer component.

18. The method of claim 16, wherein prior to sequentially introducing the gas generant segments, a strainer component having a protruding central pin and a lower metal disc is disposed in the round receptacle, so that during the sequentially introducing of the gas generant segments, each symmetric segment self-orients to be arranged circumferentially around the central pin, wherein the removing further comprises removing the strainer component having the segmented gas generant grain assembly disposed thereon.

19. The method of claim 16, wherein prior to the removing the segmented gas generant grain assembly, the conveying and sequentially introducing steps are repeated multiple times to form a stack of distinct segmented gas generant grain assemblies that are removed from the round receptacle.

20. A segmented gas generant grain assembly comprising:

a plurality of gas generant segments arranged circumferentially to define a segmented body of the gas generant grain assembly, wherein each gas generant segment has a shape that is symmetric with respect to at least one axis defined by the segment;

wherein the segmented body of the gas generant grain has a rate of breakage less than or equal to about 50%.

* * * * *